US006552251B2

(12) United States Patent
Muramatsu et al.

(10) Patent No.: US 6,552,251 B2
(45) Date of Patent: Apr. 22, 2003

(54) ACTUATING DEVICE EASILY ASSEMBLED AND KEYBOARD MUSICAL INSTRUMENT EQUIPPED THEREWITH

(75) Inventors: Shigeru Muramatsu, Shizuoka (JP); Syuzo Okabe, Shizuoka (JP)

(73) Assignee: Yamaha Corporation, Hamamatsu (JP)

( * ) Notice: Subject to any disclaimer, the term of this patent is extended or adjusted under 35 U.S.C. 154(b) by 46 days.

(21) Appl. No.: 09/871,133

(22) Filed: May 31, 2001

(65) Prior Publication Data

US 2001/0047713 A1 Dec. 6, 2001

(30) Foreign Application Priority Data

Jun. 1, 2000 (JP) ..... 2000-165146

(51) Int. Cl.[7] ..... G10F 1/22
(52) U.S. Cl. ..... 84/3; 84/19; 335/255
(58) Field of Search ..... 335/255; 84/3, 84/19–23

(56) References Cited

U.S. PATENT DOCUMENTS

| | | | |
|---|---|---|---|
| 4,031,796 | A | 6/1977 | Wilkes |
| 5,251,529 | A | 10/1993 | Burgett |
| 5,521,795 | A | 5/1996 | Burgett et al. |

FOREIGN PATENT DOCUMENTS

| | | |
|---|---|---|
| JP | 9-237082 | 9/1997 |

*Primary Examiner*—Jeffrey Donels
(74) *Attorney, Agent, or Firm*—Morrison & Foerster LLP

(57) ABSTRACT

An automatic player piano is equipped with a key actuating device for moving keys without fingering, and the key actuating device has a retainer embedded in the key bed for adapting plungers of solenoid-operated key actuators to the keys, respectively, wherein the retainer is formed with guide grooves defined between wall portions for permitting sliding portions of the yokes incorporated in the solenoid-operated key actuators therealong, and a worker simply presses the yoke against the wall portions by means of bolts so as to locate the plungers immediately under the associated keys.

14 Claims, 18 Drawing Sheets

ACTUATING DEVICE EASILY ASSEMBLED AND KEYBOARD MUSICAL INSTRUMENT EQUIPPED THEREWITH

FIELD OF THE INVENTION

This invention relates to a keyboard musical instrument and, more particularly, to a keyboard musical instrument for automatically playing a tune without fingering on the keyboard and a key actuating device incorporated therein.

DESCRIPTION OF THE RELATED ART

An automatic player piano is an example of the keyboard musical instrument for automatically playing a tune without fingering on the keyboard. The automatic player piano is usually broken down into an acoustic piano and an automatic playing system. A standard upright piano or a standard grand piano is used as the acoustic piano. A key actuating device and a controller are incorporated in the automatic playing system. Plural solenoid-operated key actuators are arrayed in two rows in a staggered fashion, and are assembled with a framework. The framework is fixed to the key bed of the acoustic piano, and the plural solenoid-operated key actuators are opposed to the rear portions of the black/white keys.

When a user instructs the controller to play a tune, the controller acquires a set of music data codes representative of the tune, and gets ready for an automatic performance. The controller is sequentially interpreting the music data codes of the set, and selectively energizes the solenoid-operated key actuators. When the solenoid-operated key actuators are energized, the solenoids generate magnetic fields, and the plungers project from the associated solenoids so as to push the rear portions of the associated black/white keys. Then, the key action mechanisms are actuated, and the hammers are driven for free rotation toward the associated strings. The hammers strike the associated strings at the ends of the free rotations. The strings vibrate, and generate the piano tones. Thus, the automatic playing system plays the tune on the keyboard without any fingering.

A typical example of the key actuator device is disclosed in Japanese Patent Publication of Unexamined Application No. 9-237082. FIGS. 1 and 2 show the prior art automatic player piano equipped with the key actuating device. Reference numeral 100 designates a key actuating device. An acoustic piano has a key bed 101, and a slot 102 is formed in the key bed 101. A key frame is mounted on the key bed 101, and plural black/white key 103 are rotatably supported by a balance rail (not shown) on the key frame. The black/white keys 103 form in combination a keyboard. The slot 102 is located under the rear portions of the black/white keys 103, and is prolonged in the lateral direction of the key bed. The lateral length of the slot 102 is not shorter than the width of the keyboard, and the key actuating device 100 is opposed to the rear portion of the keyboard in the slot 102.

The key actuating device 100 is broken down into a framework 110 and array of solenoid-operated key actuator units 120. The solenoid-operated key actuator units 120 are respectively associated with the black/white keys, and are fixed to the framework 110. The framework 110 is secured to the key bed 101, and keeps the array of solenoid-operated key actuator units 120 in the slot 102. The solenoid-operated key actuator units 120 are retained under the rear portions of the black/white keys 103, and are respectively aligned with the rear portions.

The framework 110 is broken down into a base plate 111, a center wall 112 and a bracket 113. The bracket 113 is formed with a hole as long as the slot 102, and is screwed to the lower surface of the key bed 101 so that the holes underlies the slot 102. Holes are formed in the brackets at intervals. The base plate 111 has a land portion and a pair of fins. The land portion has a cross section like an inverted U-letter, and a slit is formed in the land portion. The fins outwardly project from the both sides of the land portion, and holes are formed in the fins at intervals. The land portion is as long as the slot 102, and is narrower than the slot 102. When the land portion is inserted into the slot 102, the brackets 113 is underlain by the side fins, and the holes formed in the brackets 113 are aligned with the holes formed in the fins. Bolts are screwed into the holes so as to fix the base plate 111 to the bracket 113. The bracket 113 keeps the upper surface of the land portion close to the lower surface of the key bed 101.

The center wall 112 has a cross section like a mirror image of L-letter. The vertical portion of the center wall 112 passes through the slit, and the horizontal portion of the center wall 112 underlies the lower surface of the land portion. The horizontal portion of the center wall 112 is fixed to the land portion, and a rigid circuit board is hung from the horizontal portion of the center wall 112. The vertical portion of the center wall 112 is upright on the land portion, and projects into the slot 102. Though not shown in the figures, holes are formed in thee vertical portion at intervals, and are elongated in the vertical direction.

Each of the solenoid-operated key actuator unit 120 includes a yoke 121, a solenoid 122 and a plunger 123. The solenoid-operated key actuator units 120 are arranged in two rows, i.e., the front row and the back row. The yokes 121 of the solenoid-operated key actuator units 120 in the front row are fixed onto the front surface of the vertical portion by means of bolts 125. The bolts 125 are inserted into the elongated hole, and are screwed into threaded holes formed the yoke 121. The yokes 121 of the solenoid-operated key actuator units 120 in the back row are fixed to the back surface of the vertical portion in a staggered manner with the yokes on the front surface by means of the bolts 125 as shown in FIG. 2. For this reason, even if the solenoid-operated key actuator units 120 have relatively large solenoids 122, the yokes 121 permit the plungers 123 to be aligned with the relatively thin black/white keys 103, respectively. The bolts 125 pass through the elongated holes, and are screwed into the threaded holes formed in the yoke 121 on the back surface of the vertical portion.

The yoke 121 is splitable into a lower plate and an upper plate, and a hollow space takes place between the lower plate and the upper plate. The solenoid 122 is accommodated in the hollow space, and is pinched therebetween. The solenoids 122 are connected to electric components arranged on the rigid circuit board. The plunger 123 is inserted into the solenoid, and is projectable from the solenoid 122. The leading end of the plunger is in proximity of the lower surface of the associated black/white key 103. When electric current flows through the solenoid 122, magnetic field is created so that the plunger 123 projects upwardly. The upward motion of the plunger 123 gives rise to the rotation of the associated black/white key 103 around the balance rail.

The solenoid-operated key actuator units 120 are assembled with the center plate 112 as follows. First, the center wall 112 is assembled with the base plate 111. Subsequently, the yoke 121 is moved on one of the front/back surfaces of the vertical portion, and the threaded holes of the yoke 121 are roughly aligned with the elongated holes of the vertical portion. The yoke 121 is vertically moved along the elongated holes so as to place the leading end of the plunger 123 at the appropriate position close to the lower surface of the rear portion of the associated black/white key 103. The bolt holes of the yoke 121 are strictly aligned with the elongated holes of the vertical portion without changing the gap between the plunger 123 and the associated black/white key 103, and the bolts 125 are inserted from the other of the front/back surfaces through the elongated holes into the threaded holes. The bolts 125 are screwed into the threaded holes, and presses the yoke 121 against the front/back surface.

Subsequently, the yoke 121 is moved to the other of the front/back surfaces of the vertical portion, and the threaded holes of the yoke 121 are roughly aligned with the elongated holes of the vertical portion. The yoke 121 is vertically moved along the elongated holes so as to place the leading end of the plunger 123 at the appropriate position close to the lower surface of the rear portion of the associated black/white key 103. The bolt holes of the yoke 121 are strictly aligned with the elongated holes of the vertical portion without changing the gap between the plunger 123 and the associated black/white key 103, and the bolts 125 are inserted from the other of the opposite surface through the elongated holes into the threaded holes. The bolts 125 are screwed into the threaded holes, and presses the yoke 121 against the back/front surface.

Other yokes 121 are alternately fixed onto the front surface and the back surface in the staggered manner. As a result, the solenoid-operated key actuator units 120 are arranged in the two rows on the front/back surfaces of the vertical portion of the center wall 112. The head portions of the bolts 125 are sandwiched between the yokes 121 on the front/back surfaces of the vertical portions.

A problem is encountered in the prior art key actuating device in that a large amount of time and labor is consumed in the assemblage. As described hereinbefore, the center plate 112 is assembled with the base plate 111. Thereafter, the solenoid-operated key actuator units are alternately fixed onto the front/back surfaces of the vertical portion of the center wall 112, and are individually adjusted to the appropriate positions. The adjusting work and the assembling work are time-consuming, and the production cost of the automatic player piano is increased.

Another problem inherent in the prior art key actuating device 100 is a poor repairablity. In other words, any one of the solenoid-operated key actuator units 120 except those at both sides of the rows is hardly changed to a new solenoid-operated key actuator unit 120. This is because of the fact that the gap between the adjacent yokes 121 are too narrow. A worker can not insert a tool into the gap. If one of the solenoid-operated key actuator units 120 is damaged, the worker is to disassemble all the solenoid-operated key actuator units 120 on either side of the damaged solenoid-operated key actuator unit 120 and assemble and adjust them, again. Thus, the user suffers from high repairing cost.

SUMMARY OF THE INVENTION

It is therefore an important object of the present invention to provide a key actuating device, actuator units of which are easily assembled thereinto without consuming a large amount of time and labor.

It is also an important object of the present invention to provide a keyboard musical instrument equipped with the key actuating device.

In accordance with one aspect of the present invention, there is provided an actuating device for actuating plural members comprising a retainer having a longitudinal direction and formed with a guide extending in the longitudinal direction, plural actuators having sliding portions engageable with the guide so as to be moved in the longitudinal direction, and a fastener provided between the plural actuators and the retainer, and securing the plural actuators at target positions.

In accordance with another aspect of the present invention, there is provided a keyboard musical instrument for generating tones comprising plural keys arranged in a lateral direction on a stationary board and moved with respect to the stationary board for specifying pitches of the tones to be generated, a tone generator responsive to the motions of the plural keys for generating the tones, and a key actuating device provided in the vicinity of the plural keys for selectively moving the plural keys without fingering of a human player and including a retainer elongated in the lateral direction and formed with a guide extending in the lateral direction, plural actuators having sliding portions engageable with the guide so as to be moved in the lateral direction and a fastener provided between the plural actuators and the retainer and keeping the plural actuators at target positions in proximity to the plural keys, respectively.

BRIEF DESCRIPTION OF THE DRAWINGS

The features and advantages of the keyboard musical instrument and the solenoid-operated actuator device will be more clearly understood from the following description taken in conjunction with the accompanying drawings in which.

DESCRIPTION OF THE PREFERRED EMBODIMENTS

First Embodiment

Allover Structure of Automatic Player

Figure 1:
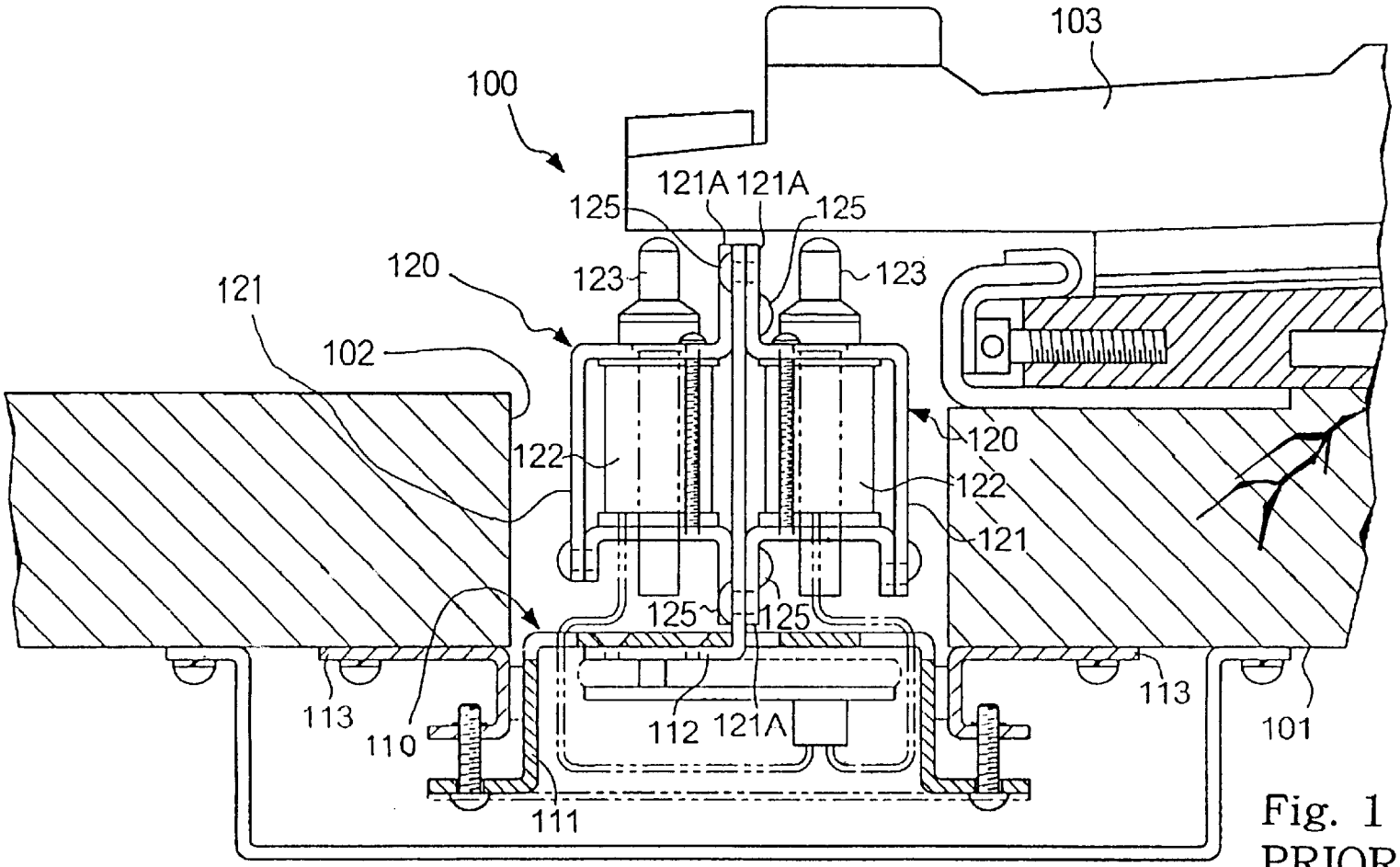
Fig. 1 PRIOR ART
FIG. 1 is a partially cut-away side view showing the structure of the prior art automatic player piano.
Figure 2:
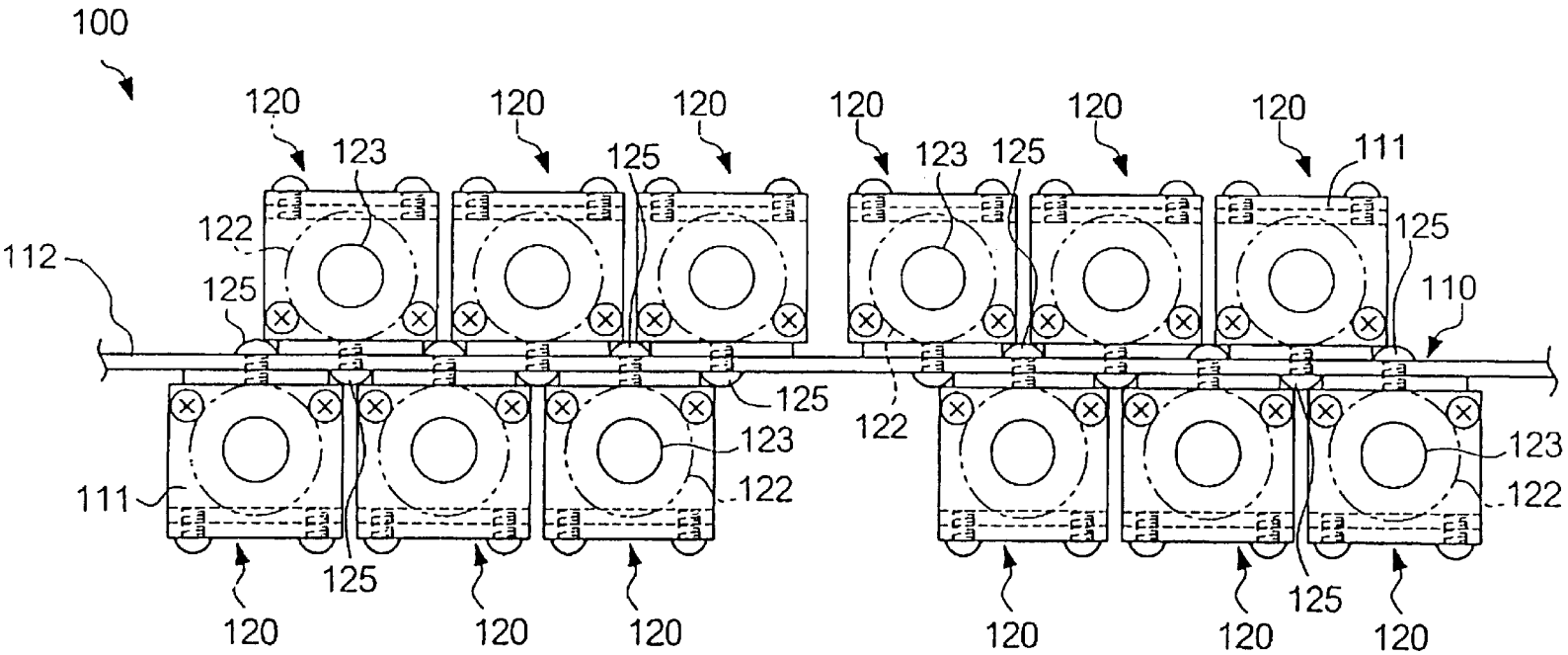
Fig. 2 PRIOR ART
FIG. 2 is a plane view showing the staggered arrangement of the solenoid-operated key actuator units incorporated in the prior art automatic player piano.
Figure 3:
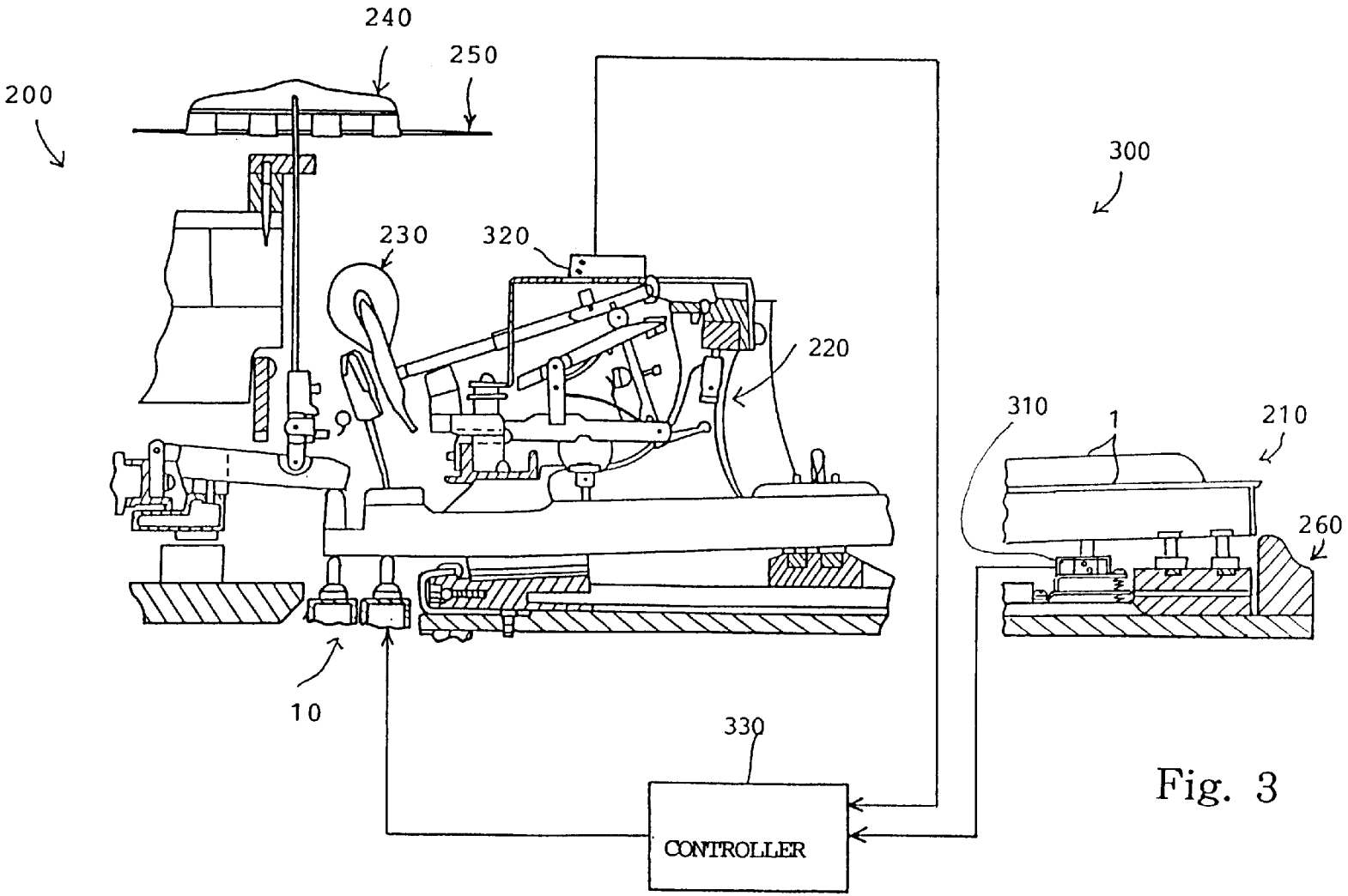
FIG. 3 is a schematic side view showing an automatic player piano according to the present invention.

Referring to FIG. 3 of the drawings, an automatic player piano embodying the present invention largely comprises an acoustic piano 200 and an electronic system 300. In this instance, a grand piano is used as the acoustic piano 200, and the electronic system 300 serves as a recording system as well as an automatic playing system. A pianist can instruct the electronic system 300 to record his or her performance. While the pianist is playing a tune on the acoustic piano 200, the electronic system 300 converts key motions, hammer motions and pedal motions to music data codes. When the pianist reaches the end of the tune, the electronic system 300 stores the set of music data codes in a suitable memory, or transfers it to another musical instrument. The electronic system 300 may transfer the music data codes to another musical instrument in a real time fashion. On the other hand, when the pianist instructs the electronic system 300 to reproduce the performance, the electronic system 300 acquires the set of music data codes, and starts to interpret the music data codes sequentially. The electronic system 300 plays the tune without fingering, and reproduces the performance. Thus, the electronic system 300 performs a recorder as well as an automatic player. The electronic system 300 equipped with key sensors 310, hammer sensors 320 and pedal sensors (not shown) for converting the key motions, the hammer motions and the pedal motions to electric signals. A controller 330 is shared between the recording system and the automatic playing system. The controller 330 processes the electric signals so as to produce a set of music data codes representative of a performance on the acoustic piano. The electronic system 300 serving as the automatic player piano will be hereinlater described in detail.

Structure of Acoustic Piano

In the following description, words "front" and "rear" represent relative positions on the acoustic piano. A front position is closer to a pianist sitting in front of the acoustic piano than a rear position. Words "fore-and-aft direction" are indicative of a virtual line drawn between a front position and a rear position, and "lateral direction" is perpendicular to the fore-and-aft direction.

The acoustic piano 200 comprises a keyboard 210, action mechanisms 220, hammers 230, dampers 240, sets of strings 250, a housing 260 and pedal system (not shown) as similar to those incorporated in a standard grand piano.

Plural black/white keys 1 are laid on the well-known pattern in the lateral direction, and form the keyboard 210. The black/white keys 1 extend in parallel in the fore-and-aft direction. The action mechanisms 220 are linked with the black/white keys 1. A human pianist or the automatic player gives rise to the key motions, and the action mechanisms 220 are independently actuated by the moved keys 1. The hammers 230 are driven for free rotation toward the associated sets of strings 250 by the actuated action mechanisms 220, and strike the associated strings 250 at the end of the free rotations.

The dampers 240 are also actuated by the moved keys 1. While the black/white keys 1 are staying at the rest position, the dampers 240 are in contact with the sets of strings 250 so as to prevent the set of strings 250 from vibrations. When the damper 240 is actuated by the associated black/white key 1, the damper 240 is spaced from the associated set of strings 250, and permits the set of strings 250 to vibrate. After the permission, the hammers 230 strikc the sets of strings 250. The damper 240 is brought into contact with the associated set of strings 250 after releasing the black/white key 1. Thus, the black/white keys 1, the action mechanisms 220, the hammers 230, the dampers 240 and the strings 250 behave as similar to those of the standard grand piano.

The action mechanisms 220, the hammers 230, the dampers 240 and the strings 250 are accommodated in the housing 260, and front portions of the black/white keys are exposed to a pianist. A key bed 2 forms a part of the housing 260, and the keyboard 210 is mounted on the key bed 2.

Key Actuating Device

Figure 4:
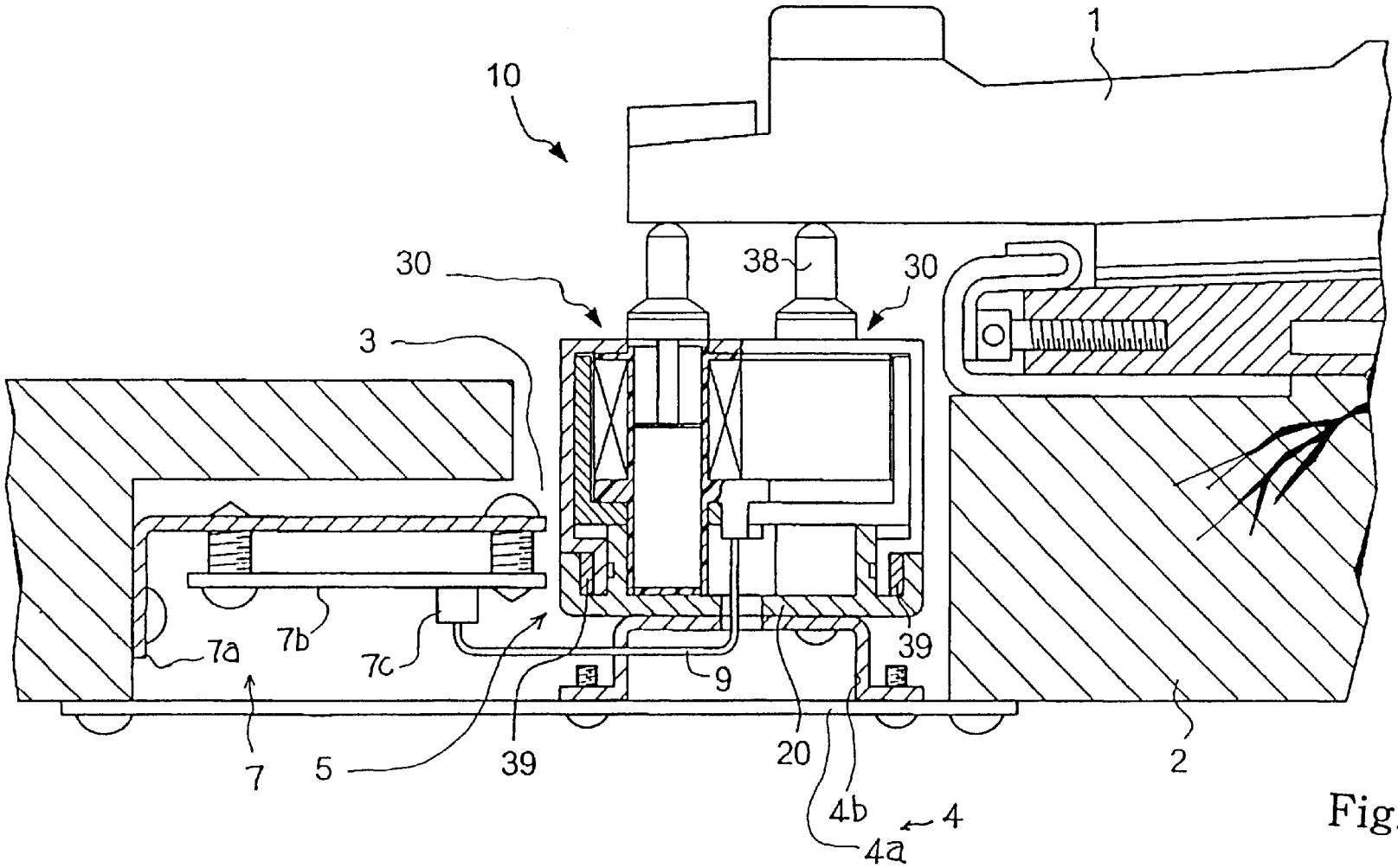
FIG. 4 is a partially cut-away side view showing a key actuating device incorporated in the automatic player piano.

The electronic system 300 serving as the automatic player further comprises a key actuating device 10. As will be seen in FIG. 4, a hollow space 3 is formed in the key bed 2. The hollow space 3 is open to both of the upper and lower surfaces of the key bed 2, and is elongated in the lateral direction. The key actuating device 10 is accommodated in the hollow space 3, and is opposite to the rear portions of the black/white keys 1.

The key actuating device 10 is broken down into a framework 4, a retainer 5, a power supply unit 7 and plural solenoid-operated key actuator units 30. The framework 4 is fixed to the key bed 2, and the keeps the solenoid-operated key actuator units 30 stationary in the hollow space 3. The retainer 5 is provided between the framework 4 and the solenoid-operated key actuator units 30, and supports the solenoid-operated key actuator units 30 upright over the framework 4 in alignment with the black/white keys 1, respectively. The power supply unit 7 is fixed to the key bed 2, and is connected through lead wires 9 to the solenoid-operated key actuator units 30. The power supply unit 7 is responsive to instructions of the controller 330 so as to selectively supply electric power through the lead wires 9 to the solenoid-operated key actuator units 30.

Figure 5:
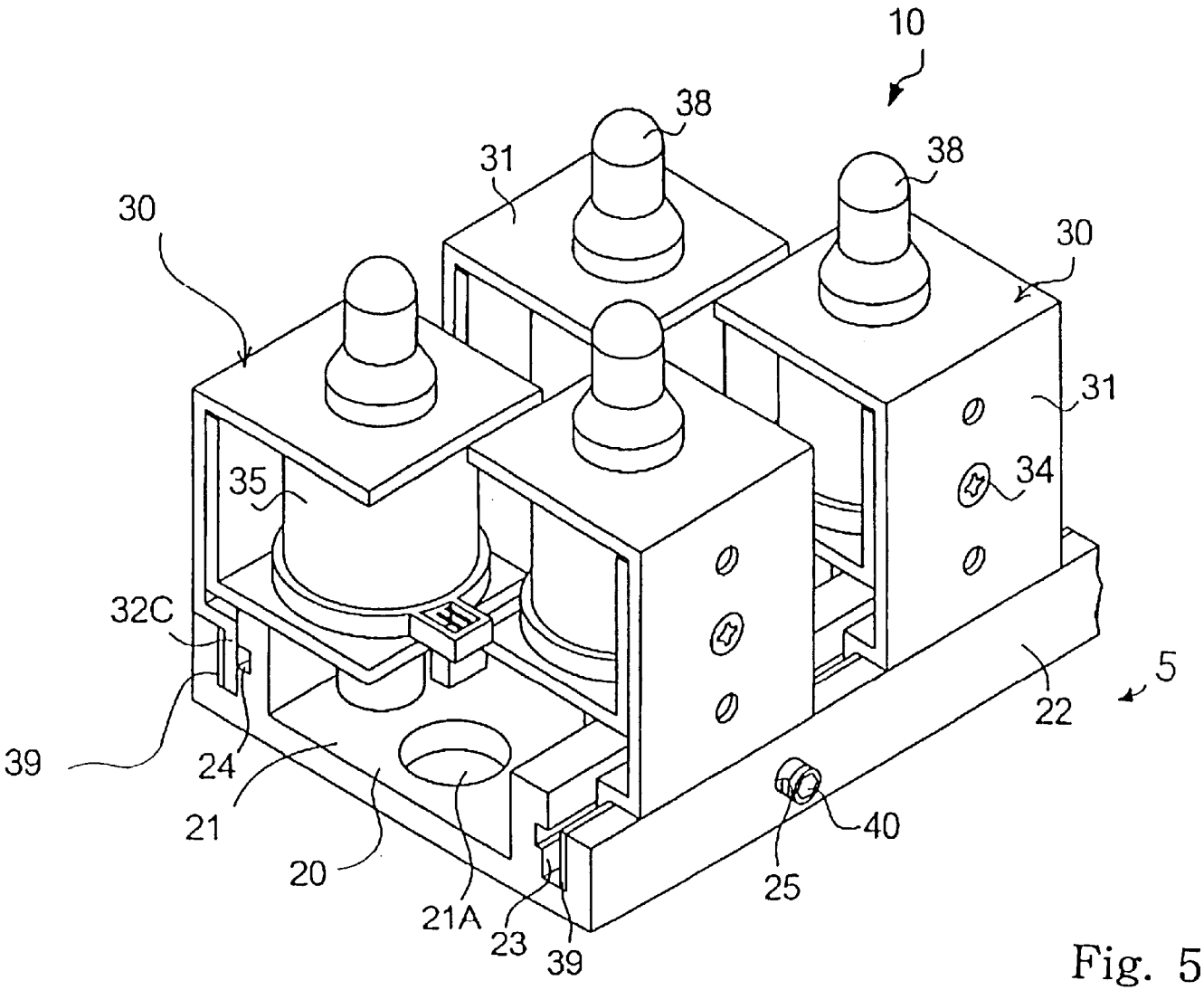
FIG. 5 is a perspective view showing solenoid-operated key actuator units on a retainer.
Figure 6:
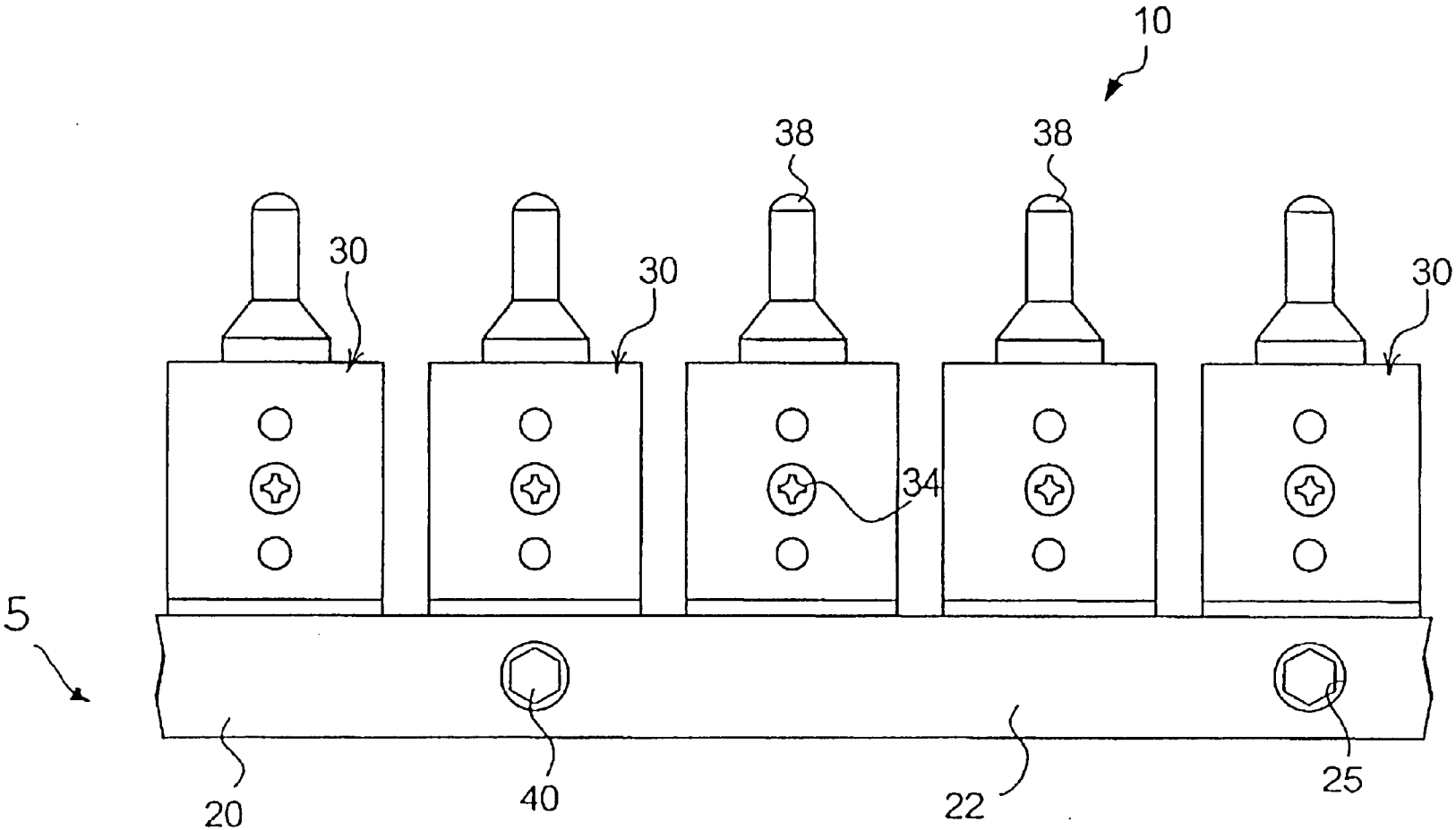
FIG. 6 is a front view showing the solenoid-operated key actuator units on the retainer.

In detail, a base plate 4*a* and a bracket 4*b* form in combination the framework 4. The bracket 4*b* is fixed to the upper surface of the base plate 4*a*, and the base plate 4*a* is screwed to the lower surface of the key bed 2. The hollow space 3 is closed with the base plate 4*a*, and the bracket 4*b* laterally extends under the rear portions of the black/white keys 1. The retainer 5 is fixed to the bracket 4. The solenoid-operated key actuator units 30 are arranged in two rows, and the rows of solenoid-operated key actuator units 30 are retained by the retainer 5 in a staggered manner as shown in FIGS. 5 and 6. The retainer 5 and the solenoid-operated key actuator units 30 will be described in detail hereinlater.

The power supply unit 7 includes a bracket 7*a*, a rigid circuit board 7*b* and an electric device 7*c*. The bracket 7*a* has a cross section like an L-letter, and is fixed to the inner surface of the key bed 2. The rigid circuit board 7*b* is hung from the bracket 7*a*, and the electric device 7*c* is fixed to a conductive patter formed on the lower surface of the rigid circuit board 7*b*. The electric device 7*c* serves as a power supply circuit, and is connected between the controller 330 and the lead wires 9. When the controller 330 instructs the electric device 7*c* to supply a solenoid-operated key actuator unit 30, the electric device 7*c* energizes the solenoid-operated key actuator unit 30 through the lead wire 9, and moves the associated black/white key 1 for actuating the associated action mechanism 220.

Retainer

Figure 7:
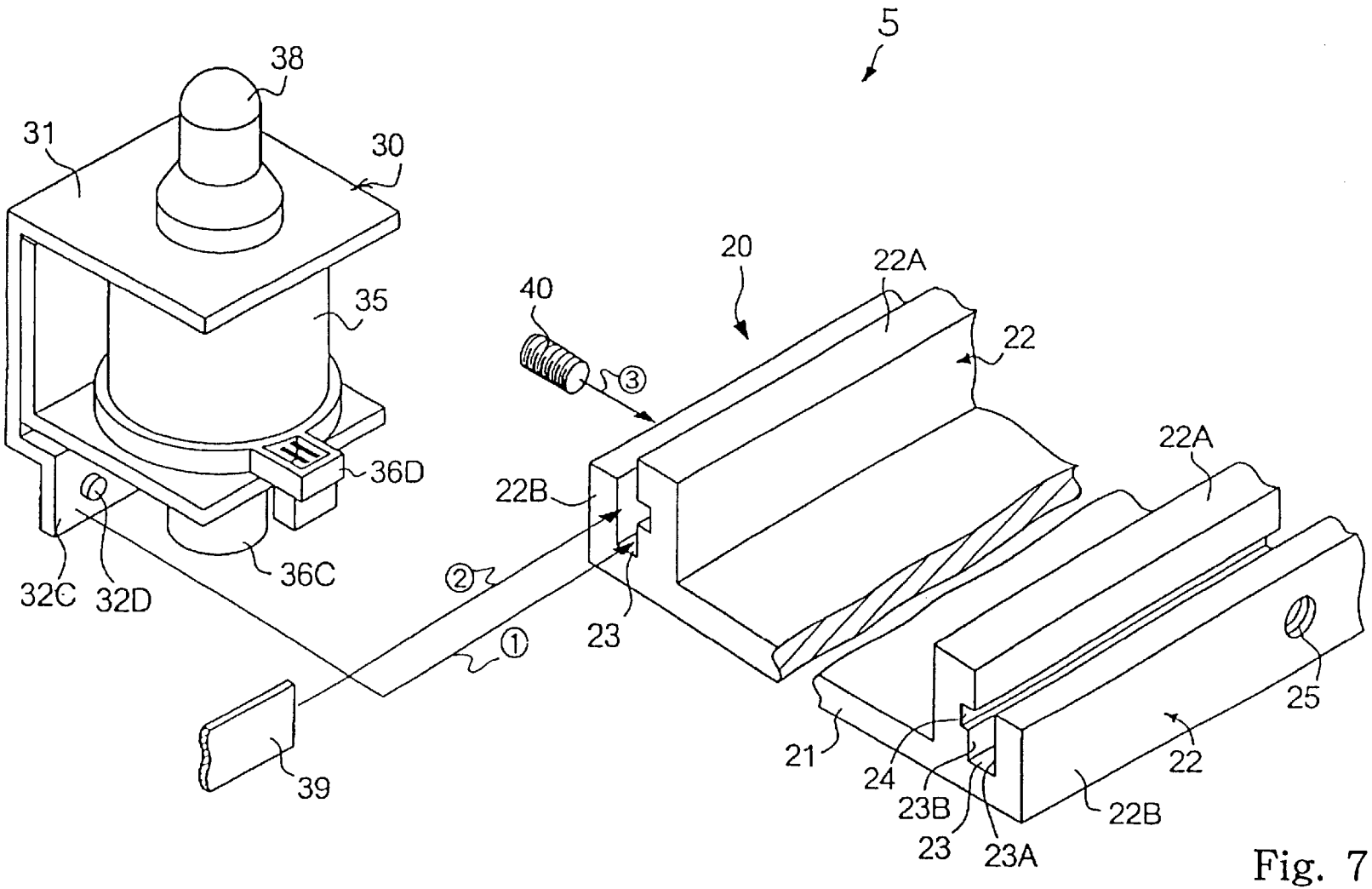
FIG. 7 is a fragmentary perspective view showing the structure of the retainer.
Figure 8:
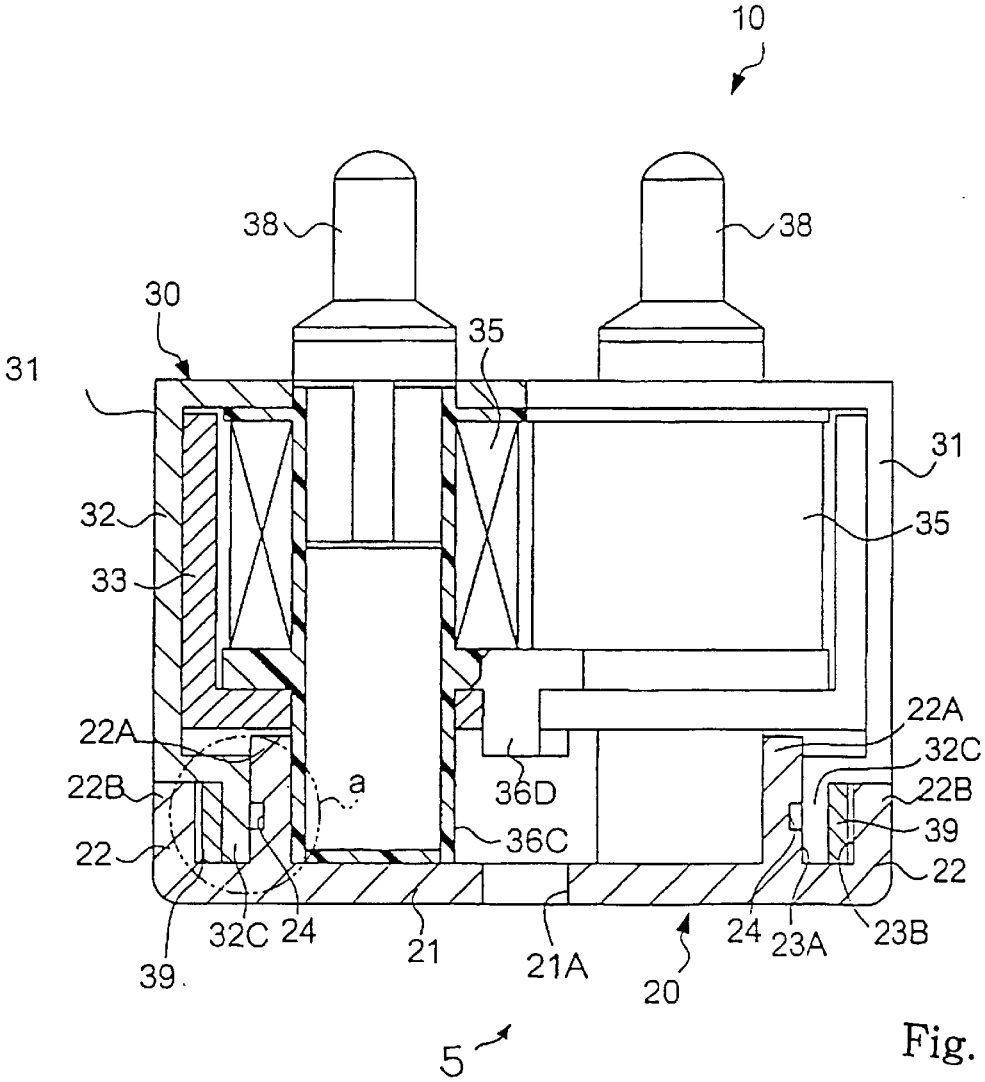
FIG. 8 is a cross sectional view showing the solenoid-operated key actuator unit fixed to the retainer.

Referring to FIGS. 7 and 8 concurrently with FIGS. 5 and 6, the retainer 5 includes a base body 20, spacer plates 39 and set-screws 40. The base body 20 is fixed to the upper surface of the bracket 4*b* of the framework 4, and is maintained in the hollow space 3. The base body 20 has a channel shape, and is long enough to support all the solenoid-operated key actuator units 30. In this instance, the base body 20 is formed from an aluminum bar through an extruding.

The base body 20 has a flat bottom portion 21, inner wall portions 22A and outer wall portions 22B. The outer wall portions 22B project from front end and the rear end of the flat bottom portion 21. The inner wall portions 22A also project from the flat bottom portion 21 in parallel to the outer wall portions 22B, and are spaced from the outer wall portions 22B. Thus, the outer wall portions 22B are respectively paired with the inner wall portions 22A, and the pairs of inner/outer wall portions 22A and 22B serve as guide rails 22. The guide rails 22 laterally extend along the front end and the rear end of the flat base portion 21, and form grooves 23 together with the upper surface of the flat bottom portion 21. The inner surfaces 23A of the outer wall portions 22B are opposite to the outer surfaces of the inner wall portions 22A. The grooves 23 have a width W, and the spacer plates 39 are inserted into the grooves 23. A gap greater than t1 is left between each of the outer surfaces 23 and the spacer plate 39 of thickness t2, and the solenoid-operated key actuator units 30 are to be inserted into the gap as will be described hereinlater.

Plural through-holes 21A are formed in the flat bottom portion 21 at regular intervals for the lead wires 9 (see FIGS. 5 and 8), and the lead wires 9 pass through the through-holes 21A so as to reach the associated solenoid-operated key actuator units 30.

Positioning grooves 24 are formed in the inner wall portions 22A, and are open to the outer surfaces 23B. The positioning grooves 24 laterally horizontally extend, and the distance between the upper surface of the flat bottom portion 21 and the positioning grooves 24 is adjusted to a predetermined value so that the solenoid-operated key actuator units 20 project from the upper surface of the key bed 2 to appropriate position immediately under the lower surfaces of the associated black/white keys 1. The depth of the positioning grooves 24 is adjusted to value d.

Plural threaded holes 25 are formed in the outer wall portions 22B at intervals. In this instance, each interval is equal to the total width of three solenoid-operated key actuator units 30. Set-screws 40 are screwed into the threaded holes 25, and exert force on the spacer plates 39 inwardly. Accordingly, the spacer plates 39 press the solenoid-operated key actuator units 30 against the outer surfaces 23A of the inner wall portions 22A. Thus, the set-screws 40 and the spacer plates 39 secure the solenoid-operated key actuator units 30 to the guide rails 22, and prohibit the solenoid operated key actuator units 30 from unintentionally sliding in the grooves 23.

Solenoid-Operated Key Actuator Unit

Figure 9:
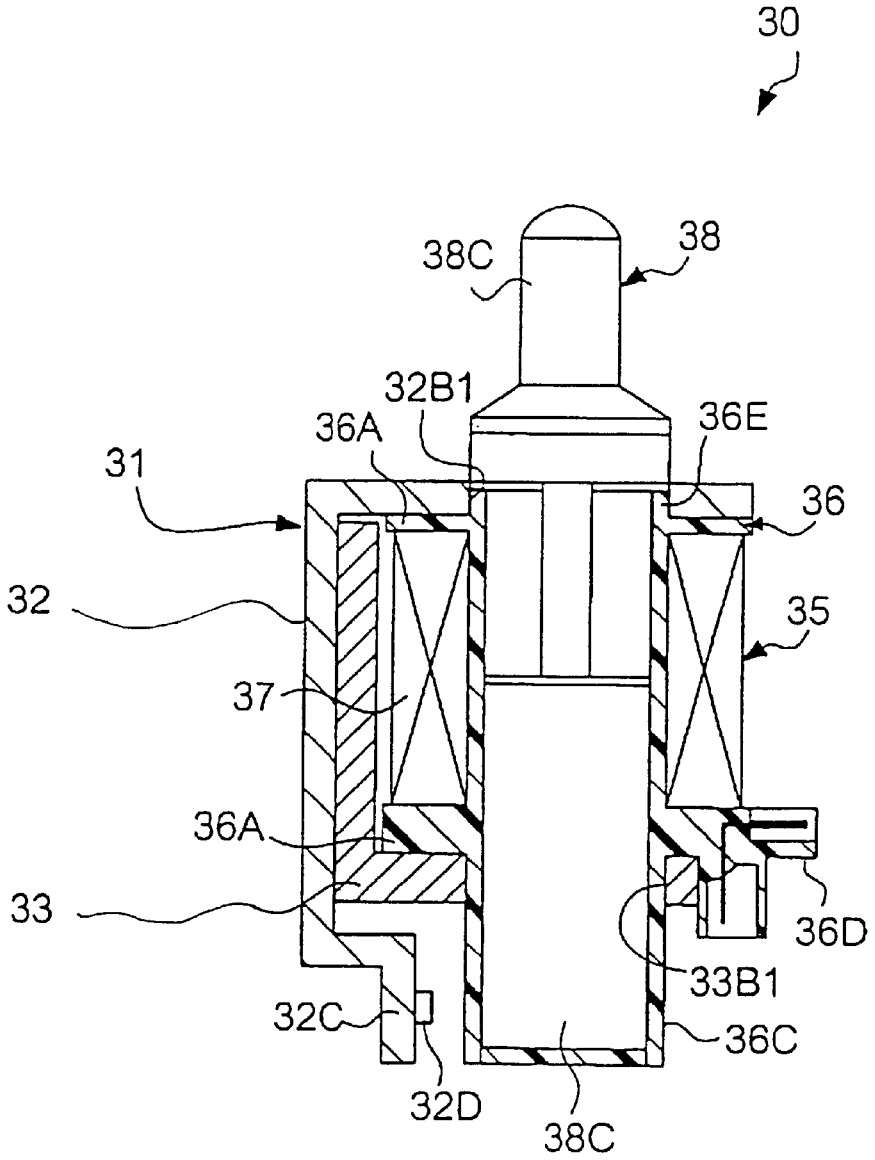
FIG. 9 is a cross sectional view showing the structure of the solenoid-operated key actuator unit.
Figure 10:
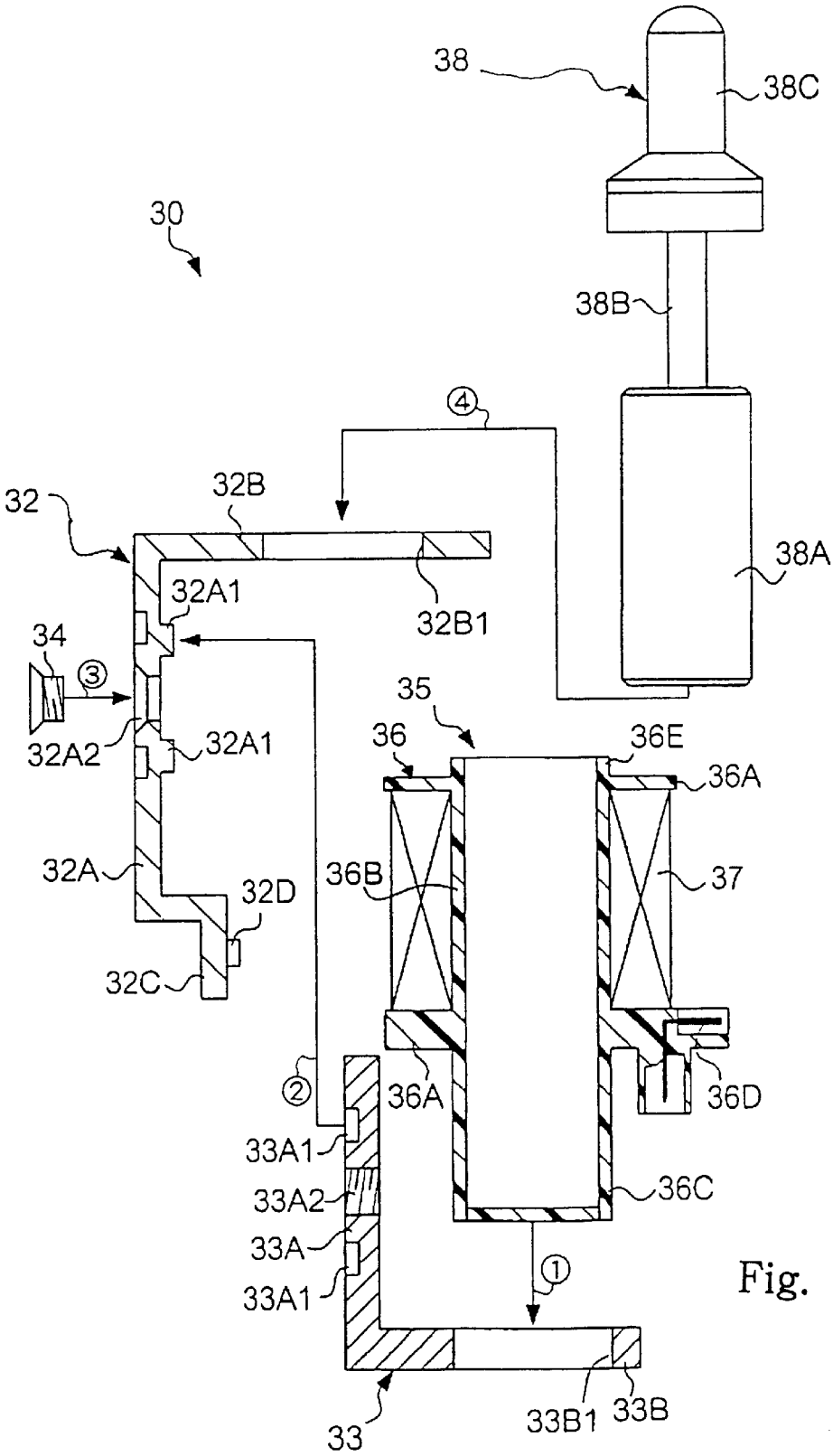
FIG. 10 is a view showing the solenoid-operated key actuator unit separated into parts.

The solenoid-operated key actuator units 30 are identical in structure to one another, and, for this reason, description is made on one of the solenoid-operated key actuator units 30 with reference to FIGS. 9 and 10.

The solenoid-operated key actuator unit includes a yoke 31, a solenoid 35 and a plunger 38. The yoke 31 is formed of magnetic substance, and a magnetic path is to be created in the yoke 31. The yoke 31 is split into two parts 32 and 33, and the solenoid 35 has a coil 37 wound on a bobbin 36. A through-hole 32A1 is formed in the yoke part 32, and a threaded hole 33A2 are formed in the other yoke part 33. The yoke parts 32 and 33 are assembled together by means of a set-screw 34. The bobbin 36 is a cylindrical shape, and the plunger 38 is movably inserted into the bobbin 36.

The yoke part 32 has a flat vertical portion 32A, an upper flat portion 32B and a lower angle bar portion 32*c*. A pair of projections 32A1 is formed on the inner surface of the flat vertical portion 32A, and one of the projections 32A1 is spaced from the other projection 32A1 by a predetermined distance. The projections 32A1 may be formed through the half-punching. The upper flat portion 32B horizontally projects from the upper end of the flat vertical portion 32A, and a through-hole 32B1 is formed in the upper flat portion 32B, and is equal in diameter to a cylindrical body 36B of the bobbin 36. The angle bar portion 32*c* is connected to the lower end of the flat vertical portion 32A. The angle bar portion 32*c* horizontally projects in parallel to the upper flat portion 32B, and is directed downwardly. The downwardly directed portion of the angle bar portion 32C has the thickness t1, and is loosely inserted into the gap between the spacer plate 39 and the inner wall portion 22A. A button 32D is formed in the downwardly directed portion. The button 32D is formed through a half-punching, or is adhered to the downwardly directed portion. The width h of the button 32D is less than the depth d of the positioning groove 24, and the diameter of the button 32D is slightly smaller in value than the width of the positioning groove 24. Thus, the button 32D is inserted into the positioning groove 24, and is slidable along the positioning groove 24.

The other yoke part 33 is like a short angle bar, and, accordingly, has a flat vertical portion 33A and a flat horizontal portion 33B. The flat vertical portion 33A is shorter than the flat vertical portion 32A so that the flat vertical portion 33A1 is insertable into the gap between the upper flat portion 32B and the angle bar portion 32C. A pair of dents 33A1 is formed in the yoke part 33, and is open to the outer surface of the yoke part 33. One of the dents 33A1 is spaced from the other dent 33A1 by the predetermined distance. When the yoke parts are assembled together, the projections 32A1 are received into the dents 33A1, respectively, and the flat vertical portion 32A is held in face-to-face contact with the flat vertical portion 33A so as to reduce the magnetic resistance. Thus, the pair of projections 32A1 and the pair of dents 33A1 serve as a positioning means, and make the through-hole 32A2 aligned with the threaded hole 33A2. A though-hole 33B1 is formed in the flat horizontal portion 33B, and is equal in diameter to the cylindrical body 36*b* of the bobbin 36. When the pair of projections 32A1 are snugly received in the pair of dents 33A1, the through-hole 33B1 is aligned with the through-hole 32B1.

The bobbin 36 is formed of synthetic resin, and has two brims 36A and the cylindrical body 36B. The brims 36A project from the cylindrical body 36B, and is spaced in the up-and-down direction. The brims 36A divide the cylindrical body 36B into a lower guard portion 36C, an upper end portion 36E and an intermediate portion. The coil 37 is wound on the intermediate portion of the cylindrical body 36B. The lower guard portion 36C is inserted into the through-hole 33B1 until the lower brim 36A is brought into contact with the flat horizontal portion 33B and the through-hole 32B1 permits the upper end portion 36E to pass therethrough until the upper flat portion 32*b* is brought into contact with the upper brim 36A.

A connector 36D is incorporated in the bobbin 36. The connector 36D is implemented by a conductive metal plug.

The conductive metal plug 36D has an L-letter shape, and projects partially in the horizontal direction and partially in the up-and-down direction. The coil 37 is connected to the horizontal portion of the conductive metal plug 36D, and the lead wire 9 is connected to the downward portion of the conductive metal plug 36D. A guard portion of the lower brim 36A offers a protection against undesirable external force to the conductive metal plug 36D.

The plunger 38 is broken down into a thick rod portion 38A, a thin rod portion 38B and a plunger head 38C. The rod portions 38A and 38B are formed of magnetic substance. The thick rod portion 38A is approximately equal in diameter to the inner space defined in the cylindrical body 36, and is movably inserted into the cylindrical body 36. The centerline of the thin rod portion is aligned with the centerline of the thick rod portion 38A, and the plunger head 38C is attached to the leading end of the thin rod portion 38B. The plunger head has a boss portion larger in diameter than the inner space defined in the cylindrical body 36B so that the plunger head 38C sets a lower limit of the plunger 38.

Figure 11:
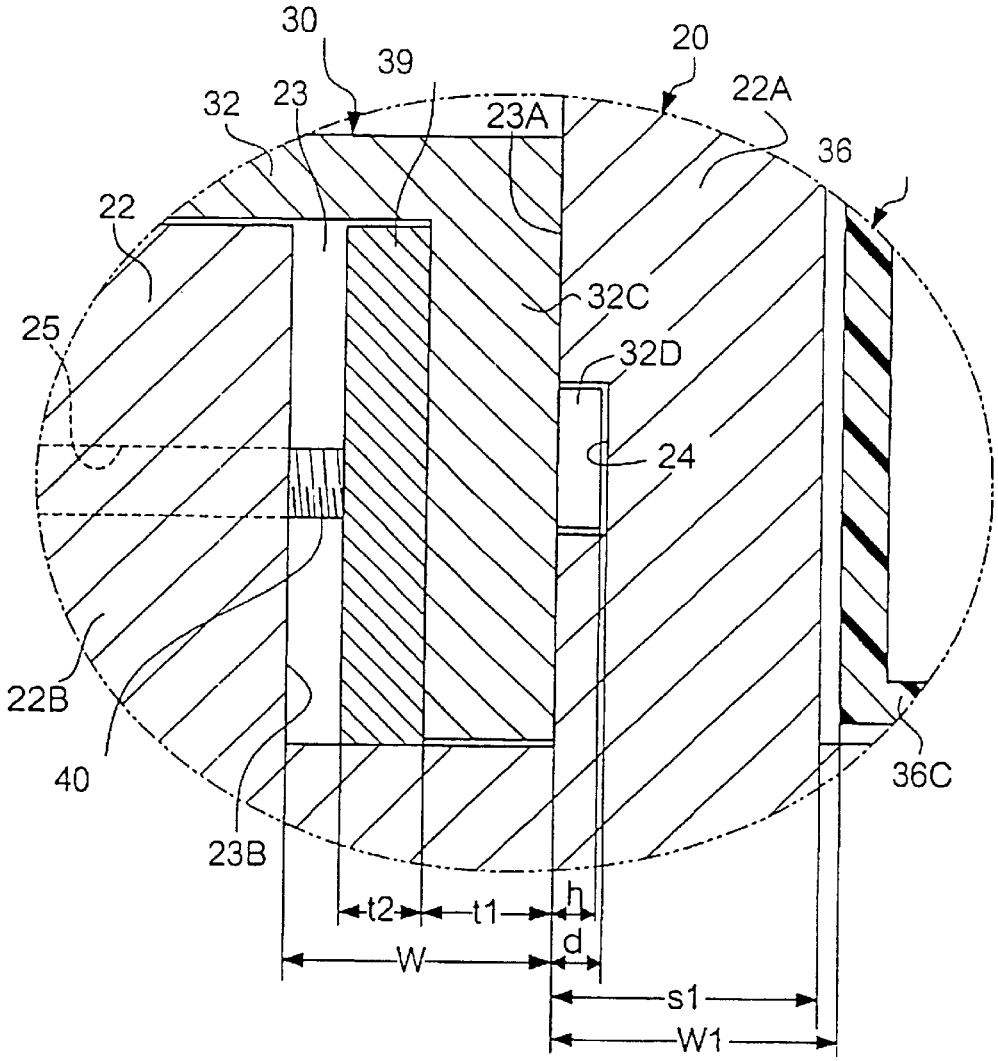
FIG. 11 is a cross sectional view showing an angle bar portion of a yoke in a guide groove encircled in "a" in FIG. 8.

The yoke part 32, the inner wall portion 22A and the solenoid 35 are designed as shown in FIG. 11. The positioning groove 24 has the depth d, and the button 32*d* has the width h. The depth h is greater than the width h so that the yoke part 32 is brought into face-to-face contact with the outer surface 23A of the inner wall portion 22A. The friction between the yoke portion 32 and the inner wall portion 22A is increased together with the force exerted on the spacer 39, and the solenoid-operated key actuator unit 30 is hardly moved in the guide groove 23. The inner wall portion 22A has the thickness s1, and the other yoke portion 33 keeps the lower guard portion 36C spaced from the downwardly directed portion of the yoke part 32 by distance W1. The distance W1 is greater than the thickness s1 so that the inner wall portion 22A never exerts any force on the bobbin 36. This means that the bobbin 36 keeps the attitude vertical. However, the gap between the inner wall portion 22A and the bobbin 36 (W1–s1) is not wide. In this instance, the gap (W1–s1) is less than the width h of the button 32D so that the button 32D is adapted to the positioning groove 24 at either side of the inner wall portion 22A.

Assemblage of Solenoid-Operated Key Actuator Unit

The parts 31, 35 and 38 are assembled into the solenoid-operated key actuator unit 30 as follows. First, the bobbin 36 is inserted into the through-hole 33B1 of the yoke part 33 as indicated by numeral 1 placed in a small circle (see FIG. 10).

Subsequently, the through-hole 32B1 is aligned with the upper end portion 36E, and the yoke parts 32 are assembled together as indicated by numeral 2 placed in a small circle. The upper end portion 36E is inserted into the through-hole 32B1, and the pair of projections 32A1 is received into the pair of dents 33A1. The pair of projections 32A1 received in the pair of dents 33A1 makes the through-hole 32A2 aligned with the threaded hole 33A2.

The set-screw 34 is screwed into the threaded hole 33A2, and secures the yoke 31 to the solenoid 35 as indicated by numeral 3 placed in a small circle. Thus, the solenoid 35 and the yoke 31 are assembled together.

The plunger 38 is inserted into the inner space of the bobbin 36 as indicated by numeral 4 placed in a small circle. The solenoid-operated key actuator unit 30 is assembled with the retainer 5 as will be described hereinlater, and the lead wire 9 is connected to the plug 36D. When the solenoid 35 is energized, a magnetic field is created, and the magnetic force causes the plunger 38 to project from the bobbin 36.

Assemblage of Key Actuating Device

Upon completion of the assemblage of all the solenoid-operated key actuator units 30, the solenoid-operated key actuator units 30 and the retainer 5 on the framework 4 are assembled into the key actuating device 10. The assemblage proceeds as follows.

First, the angle bar portion 32C is aligned with the guide groove 23, and the button 32D is adapted to the positioning groove 24. Then, the yoke 31 is pushed into the guide groove 23 as indicated by numeral 1 placed in a small circle (see FIG. 7). The positioning groove 24 adjusts the solenoid-operated key actuator unit 30 to appropriate height. Even though the solenoid-operated key actuator unit 30 slides along the guide groove 23, the solenoid-operated key actuator unit 30 does not change the height. When the plunger head 38*c* reaches a lateral position on the retainer 5 to be fit to the rear portion of the associated black/white key 1, the solenoid-operated key actuator unit 30 is not moved beyond the appropriate lateral position. Even though a worker releases his hold, the button 32*d* in the positioning groove 24 and the angle bar portion 32 in contact with the outer surface 23B prevent the solenoid-operated key actuator unit 30 from dropping, and the solenoid-operated key actuator unit 30 is maintained at the appropriate position.

The worker alternately inserts the angle bar portions 32*c* of the other solenoid-operated key actuator units 30 into the right guide groove 23 and the left guide groove 23, and fits the plunger heads 38C to the associated black/white keys 1 as similar to the above-described solenoid-operated key actuator unit 30.

Subsequently, the spacer plates 39 are inserted into the gaps between the inner surfaces 23A and the angle bar portions 32C as indicated by numeral 2 placed in a small circle in FIG. 7.

Subsequently, the set screws 40 are screwed into the threaded holes 25 as indicated by numeral 3 placed in a small circle in FIG. 7. The set screws 40 exert the force on the spacer plates 39, and, accordingly, the spacer plates 39 press the angle bar portions 32*c* against the outer surfaces 23B of the inner wall portions 22A. The large amount of friction takes place between the angle bar portions 32C and the outer surfaces 23B, and, for this reason, the solenoid-operated key actuator units 30 are secured to the retainer 5.

Finally, the framework 4 is bolted to the key bed 2. The plunger heads 38C are immediately under the rear portions of the associated black/white keys 1.

When one of the solenoid-operated key actuator units 30 is to be replaced with a new one, the bolts are loosened, and the framework 4 is carried onto a work table together with the retainer 5 and the solenoid-operated key actuator units 30. The set-screws 40 are loosened, and the spacer plate 39 is taken out from the guide groove 23. The solenoid-operated key actuator units 30 on either side are moved out of the guide groove 23, and the target solenoid-operated key actuator unit 30 is replaced with a new solenoid-operated key actuator unit 30. The solenoid-operated key actuator units 30 are assembled with the retainer 5, again.

As will be understood from the foregoing description, the worker simply slides angle bar portions 32*c* along the guide grooves 23, and presses the angle bar portions 32*c* against the outer surfaces 23B of the inner wall portions 22A. The buttons 32D and the positioning grooves 24 adjust the solenoid-operated key actuator units 30 to the appropriate height without regulating the height individually. Even if the solenoid-operated key actuator units 30 are not positioned at the appropriate lateral positions, the worker loosens the set-screws 40, and regulates the row of solenoid-operated key actuator units 30 by slightly sliding them in the guide groove 23. Thus, the assemblage is quite easy, and the worker completes the assemblage of the key actuating device 10 within a short time. This results in reduction of the production cost as well as the repairing cost.

Moreover, the base body 20 has a monolithic structure obtained through the extrusion, and is formed of highly heat-conductive material, i.e., aluminum. The worker does not need any assemblage. This results in further reduction in production cost. Although the solenoid-operated key actuator units 30 generate a large amount of heat, the heat is effectively radiated from the base body 20. Thus, the base body 20 serves as a heat sink.

Second Embodiment

Figure 12:
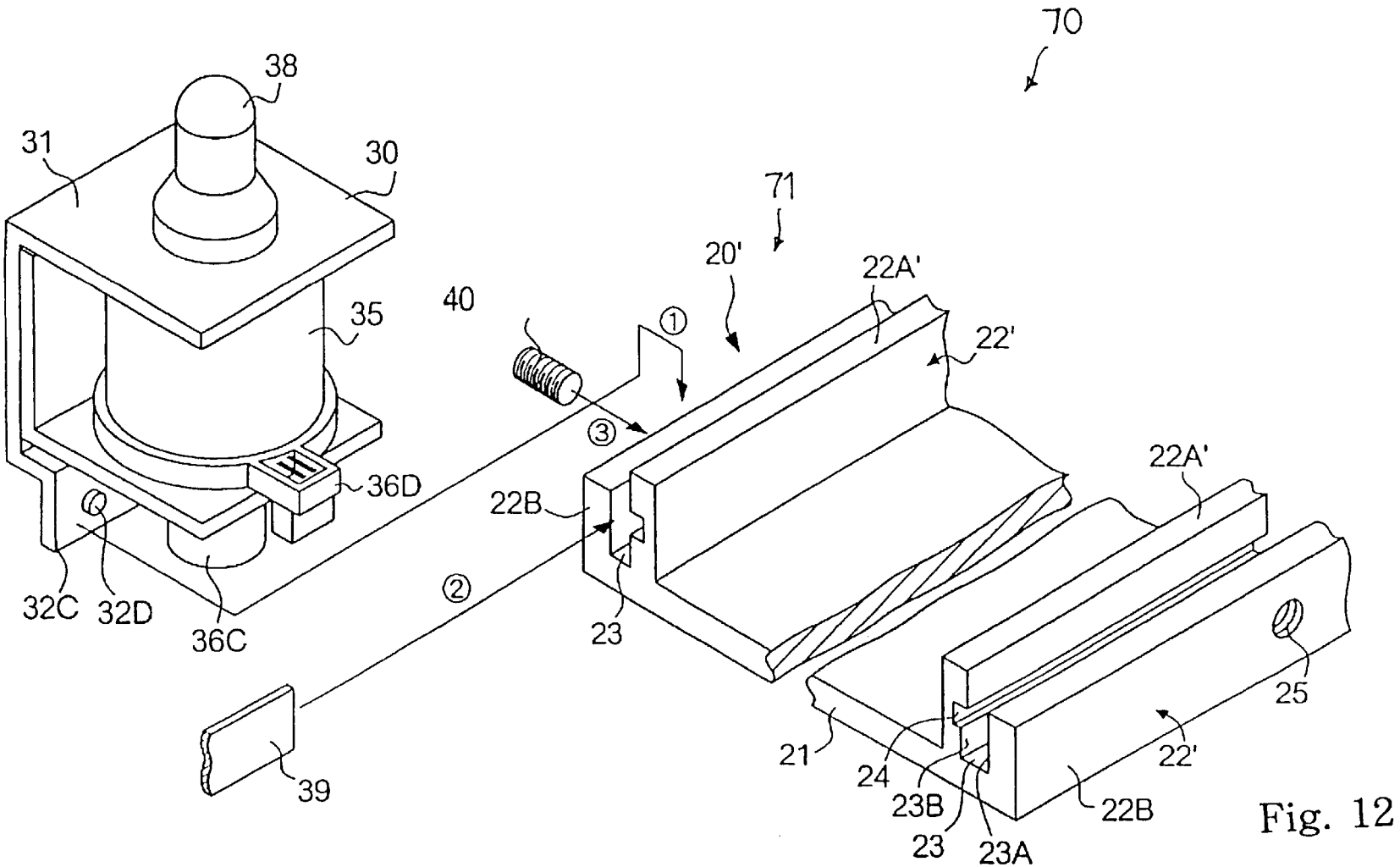
FIG. 12 is a fragmentary perspective view showing parts of a retainer incorporated in another automatic player piano according to the present invention.

Turning to FIG. 12 of the drawings, a key actuator device 70 incorporated in another automatic player piano embodying the present invention also includes a framework (not shown), a retainer 71 and plural solenoid-operated key actuator units 30. Although the automatic player piano implementing the second embodiment comprises an acoustic piano and an electronic system as similar to the first embodiment, the acoustic piano and the other components of the electronic system are similar to those of the first embodiment, and no further description is hereinbelow incorporated for the sake of simplicity.

Figure 13:
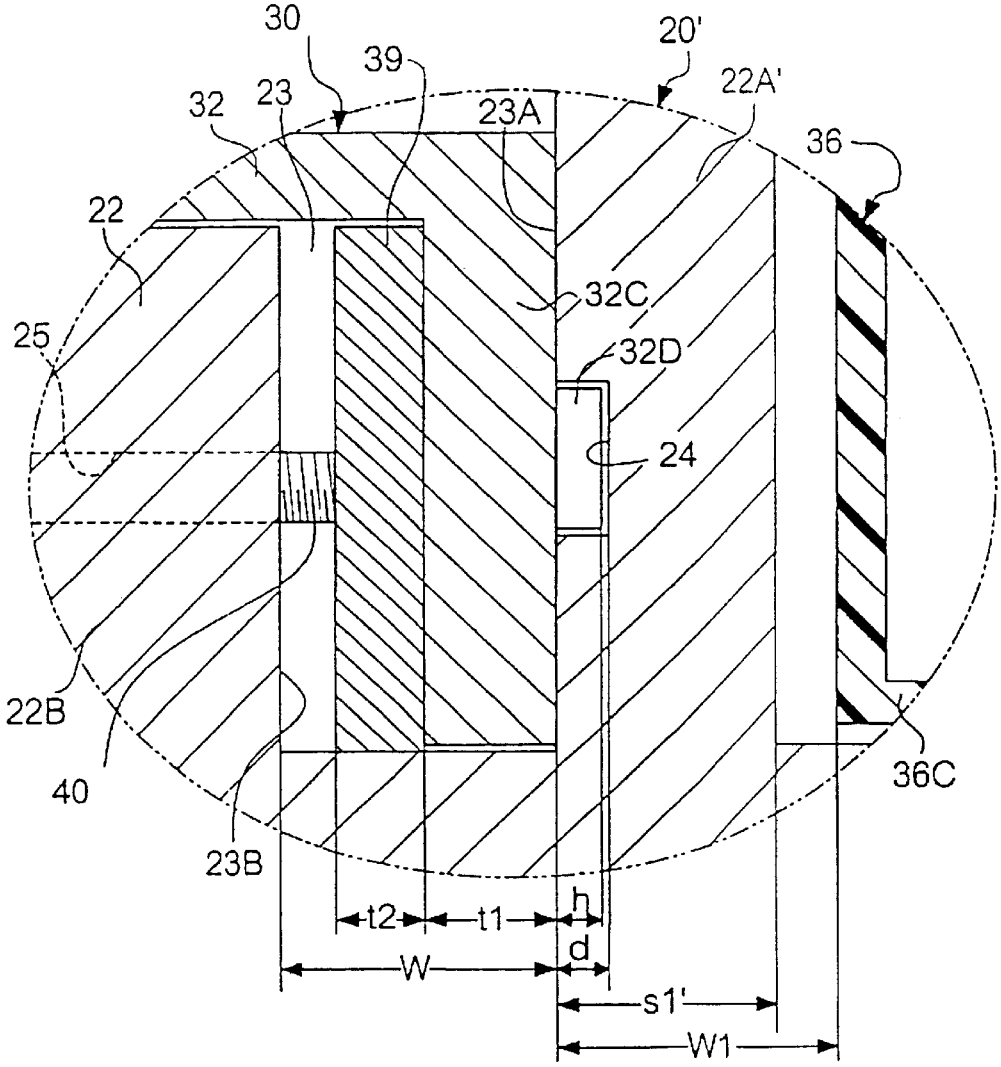
FIG. 13 is a cross sectional view showing parts corresponding to those shown in FIG. 11.

The retainer 71 includes a base body 20', the spacer plates 39 and the set-screws 40. The base body 20' is formed of a highly heat-conductive material such as, for example, aluminum, and is shaped through the extrusion so as to have a monolithic structure. The base body 20' is similar to the base body 20 except that the inner wall portions 22A' are designed to be thinner than the inner wall portions 22A. For this reason, description is focused on the inner wall portions 22A' with reference to FIG. 13.

W1, W, t, t2, h, d and s1' are indicative of the distance between the outer surface 23B of the inner wall portion 22A' and the outer surface of the bobbin 36, the width of the guide groove 23, the thickness of the angle bar portion 32C, the thickness of the spacer plate 39, the width of the button 32D, the depth of the positioning groove 24 and the thickness of the inner wall portion 22A', respectively. The thickness s1' is less than the difference between the distance W1 and the width h, i.e., (W1−h)>s1'. This means that the gap between the inner surface of the inner wall portion 22A' and the outer surface of the bobbin 36 (W1−s1') is greater than the width h of the button 32D, i.e., (W1−s1')>h. Moreover, the gap (W−t2−t1) is greater than the width h of the button 32D, i.e., (W−t1−t2)>h. Therefore, when the spacer plate 39 is in contact with the inner surface 23A of the outer wall portion 22B, a gap takes place between the button 32D and the outer surface 23B, and the bobbin 36 is still spaced from the inner surface of the inner wall portion 22A'. For this reason, a worker can slide the angle bar portion 32C into the guide groove 23 through the upper space of the guide groove 23.

The solenoid-operated key actuator units 30 are assembled with the retainer 71 as follows. First, the worker roughly adjusts the solenoid-operated key actuator 30 to an appropriate lateral position. The worker lifts the solenoid-operated key actuator unit 30 over the guide groove 23 around the appropriate lateral position, and inserts the angle bar portion 32*c* into the guide groove 23 as indicated by numeral 1 placed in a small circle in FIG. 12. The bobbin 36 is never brought into contact with the upper surface of the inner wall portion 22A', because the inner wall portion 22A' satisfies the relation of s1'<(W1−h). The worker vertically moves the solenoid-operated key actuator unit 30 in order to adapt the button 32D to the positioning groove 23, and moves the solenoid-operated key actuator unit 30 toward the outer surface 23B of the inner wall portion 22A'. Then, the button 32D is adapted into the positioning groove 24, and the solenoid-operated key actuator unit 30 is adjusted to the appropriate height.

Subsequently, the worker inserts the spacer plate 39 into the gap between the outer wall portion 22B and the angle bar portion 32C as indicated by numeral 2 placed in a small circle in FIG. 12. The worker regulates the solenoid-operated key actuator unit 30 to the appropriate lateral position through sliding it in the guide groove 23.

Finally, the worker screws the set-screws 40 into the threaded hole 25. The set-screws 40 exerts force on the spacer plate 39, and the spacer plate 39 presses the angle bar portion 32*c* against the outer surface 23B of the inner wall portion 22A'.

When one of the solenoid-operated actuator units 30 is to be replaced with a new one, the worker loosens the set-screws 40, and pulls up the solenoid-operated key actuator unit 30. The solenoid-operated key actuator unit 30 is taken out from the guide groove 23, because the guide groove 23 satisfies the relation of (W−t1−t2)>h. The worker inserts the new solenoid-operated key actuator unit 30 into the guide groove 23, and regulates the new solenoid-operated key actuator unit 30 by adapting the button 32D to the positioning groove 24. The worker screws the set-screws 40 into the threaded holes 25, again. Thus, the solenoid-operated key actuator units 30 are independently replaced with new ones without removing the spacer plates 39.

The advantages of the first embodiment are achieved by virtue of the retainer 71 and the yokes 31. Moreover, the thin inner wall portions 22A' and the wide guide grooves 23 permits a worker to replace the solenoid-operated key actuator units 30 with new ones independently. This results in further reduction of the repairing cost.

In the first and second embodiments, the black/white keys 1 are corresponding to plural keys, and the action mechanisms 220, the hammers 230 and the sets of strings 250 as a whole constitute a tone generator. The grooves 23 defined between the wall portions 22A and 22B serves as a guide, and the angle bar portions 32C are corresponding to sliding portions. The spacer plates 39 and the set-screws 40 as a whole constitute a fastener. The positioning grooves 24 and the buttons 32D form in combination a positioning device.

Although particular embodiments of the present invention have been shown and described, it will be apparent to those skilled in the art that various changes and modifications may be made without departing from the spirit and scope of the present invention.

For example, the height of solenoid-operated key actuator units 30 may be adjusted to the appropriate value by means of another positioning means. For example, positioning rails and the grooves may be formed in the inner wall portions 22A and the yokes 31, respectively.

The interval between the set-screws 40 may be shorter or longer than that of the above-described embodiment. If the interval is made to be longer, the set-screw 40 is provided for every more than three solenoid-operated key actuator units 30. If the interval is made to be shorter, the solenoid-operated key actuator units 30 between the set-screws 40 are less than three.

Figure 14:
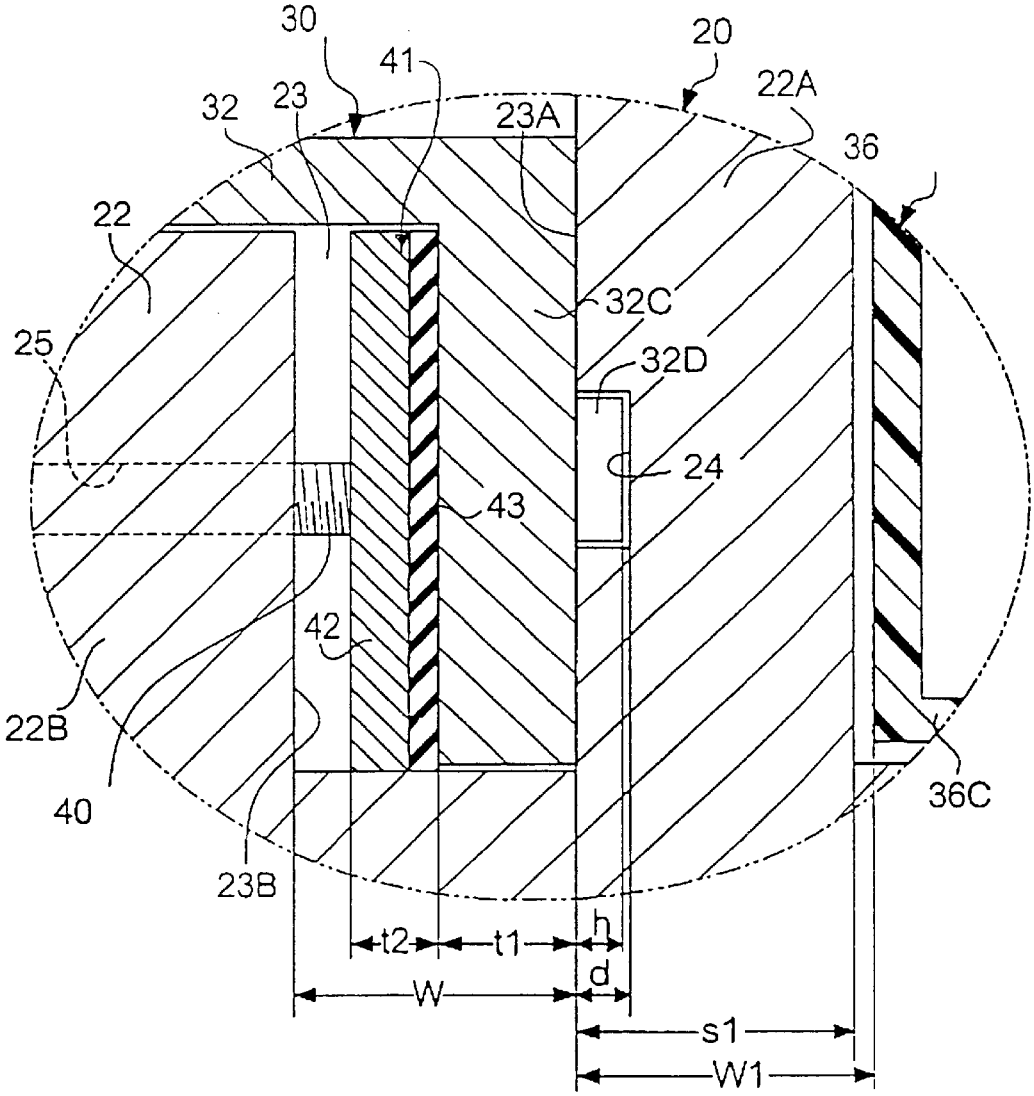
FIG. 14 is a cross sectional view showing another retainer available for the first and second embodiments.
Figure 15:
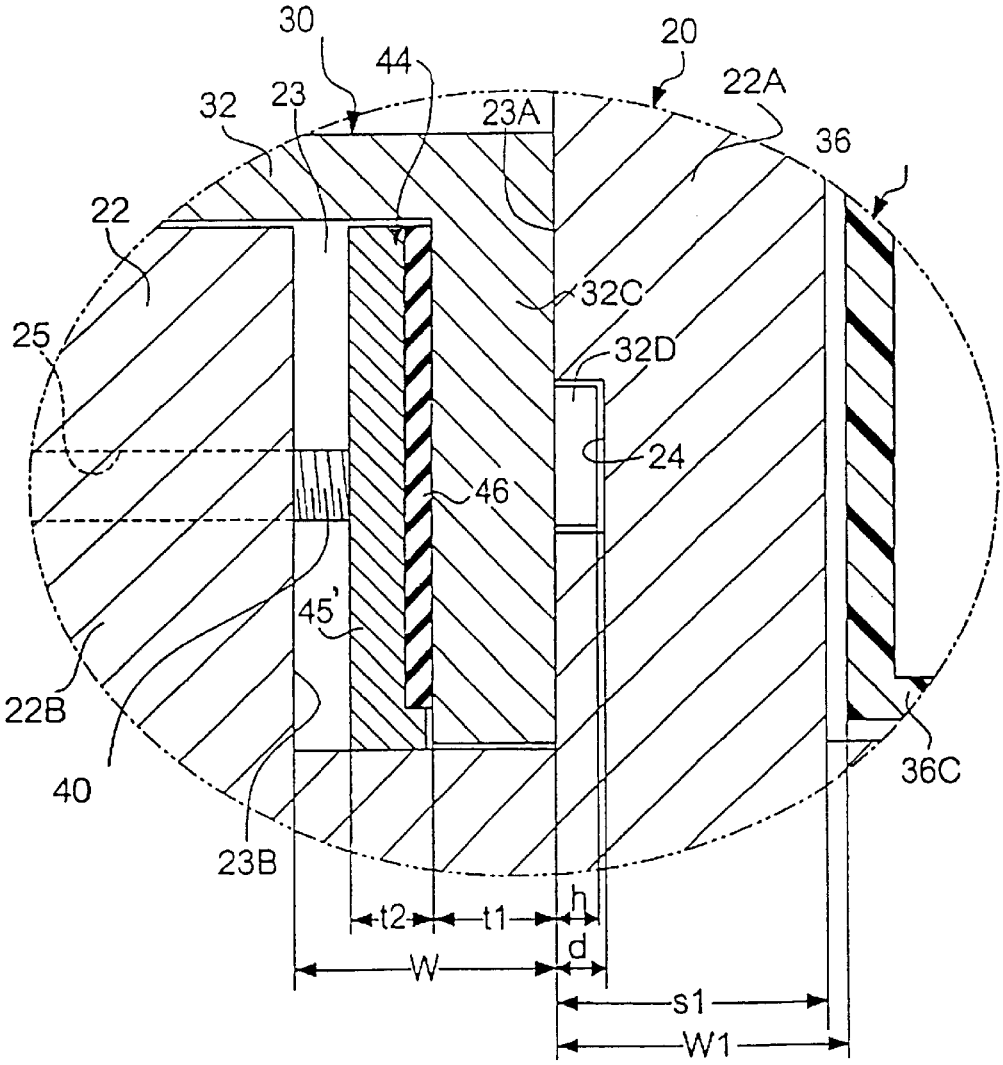
FIG. 15 is a cross sectional view showing yet another retainer available for the first and second embodiments.
Figure 16:
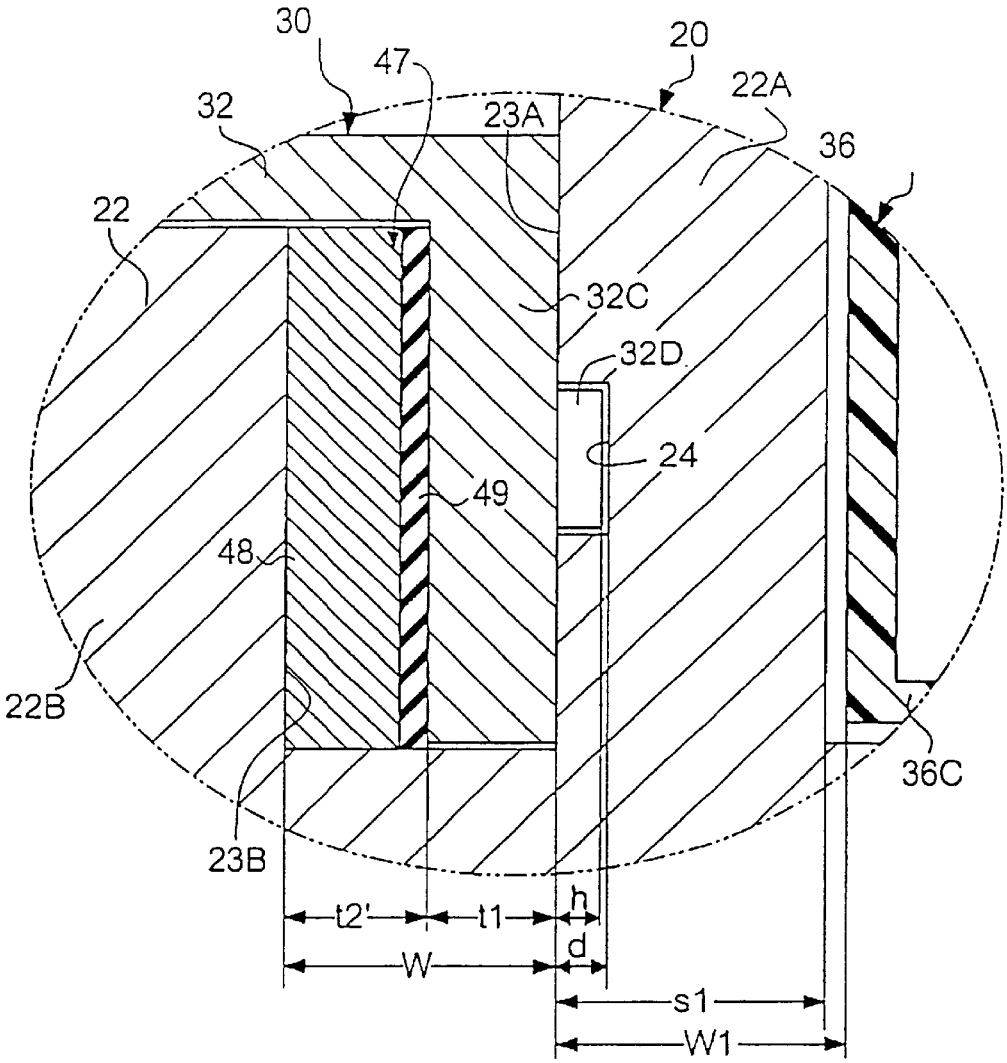
FIG. 16 is a cross sectional view showing still another retainer available for the first and second embodiments.

The spacer plate 39 may be placed with any one of the spacer plates 41, 44 or 47 shown in FIGS. 14, 15 and 16. The spacer plate 41 has a laminated structure, in which a rubber sheet 43 is bonded to a rigid plate 45 such as, for example, a metal plate. When the force is exerted to the spacer plate 41, the rubber sheet 44 is resiliently deformed, and is tightly held in contact with the angle bar portion 32C.

The spacer plate 44 also includes a rigid base 45' and the rubber sheet 44. A step is formed in the rigid base 45', and a contact surface is retracted from the remaining surface. The rubber sheet 44 is bonded to the contact surface, and projects from the remaining surface. The rubber sheet 44 is supported by the step, and, for this reason, the rubber sheet 44 keeps the position even if the rubber sheet 44 partially peels from the rigid base 45'.

Any set-screw 40 is not required for the spacer plate 47. A rubber sheet 49 is bonded to the rigid plate 48. Before the spacer plate 47 is inserted into the guide groove 23, the thickness of the spacer plate 47 is greater than t2'. While the worker is inserting the spacer plate 47, the rubber sheet 49 is deformed, and the thickness is reduced to t2'. The spacer plate 47 presses the angle bar portion 32C against the outer surface 23B due to the resilient force of the rubber sheet 49. For this reason, any set-screw 40 is required, and the usage of the spacer plates 47 permits the manufacturer to reduce the component parts.

Figure 17:
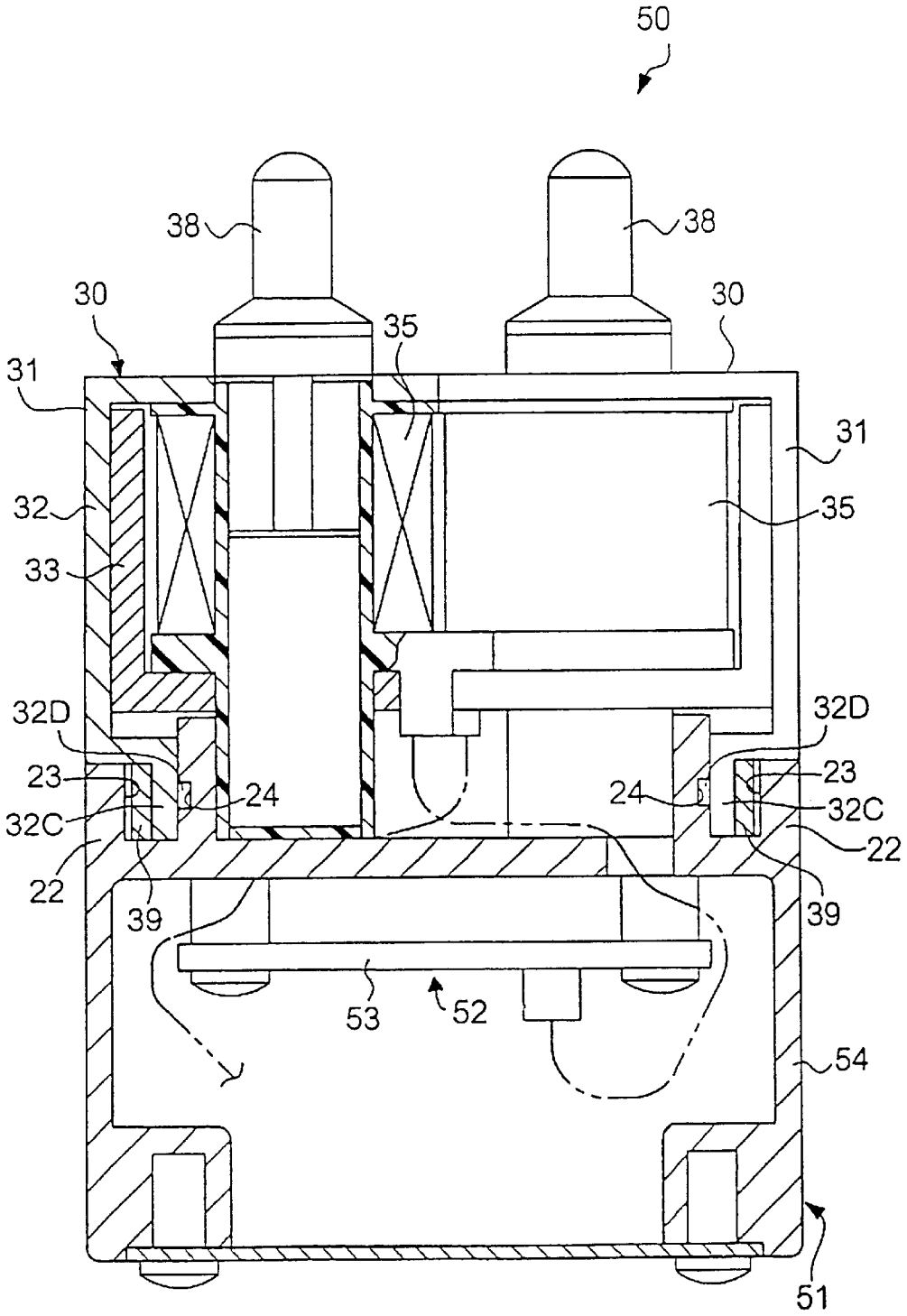
FIG. 17 is a cross sectional view showing another power supply unit avalable for the key actuating device according to the present invention.
Figure 18:
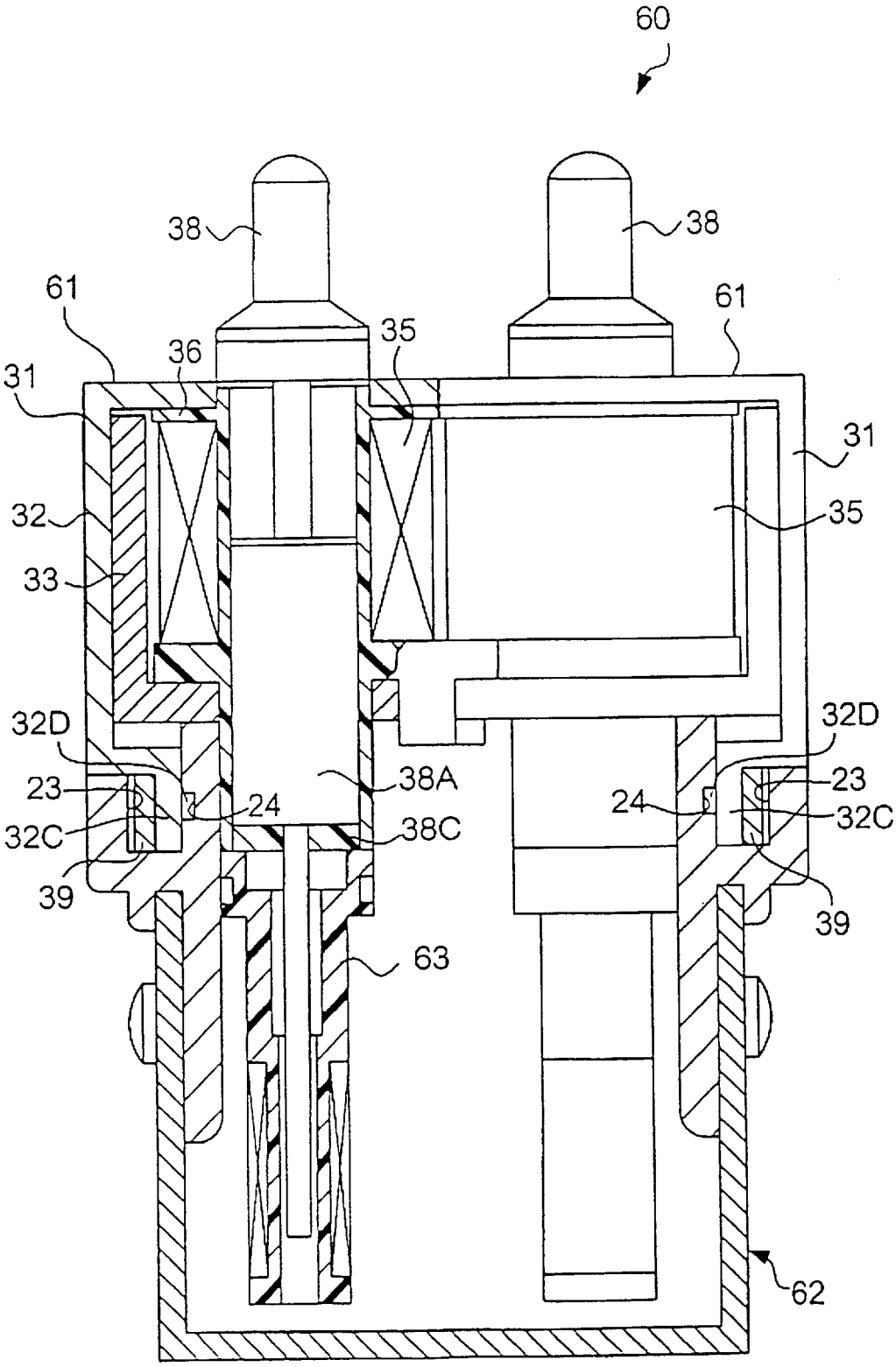
FIG. 18 is a cross sectional view showing another solenoid-operated key actuator units available for the key actuating device according to the present invention.

Another key actuating device 50 may include a base body 51 (see FIG. 17), which is shared between the retainer and an electric power supply unit 52. The base body 51 has a lower portion 54 which serves as a bracket of the electric power supply unit 52. The power portion 54 defines a hollow space. A rigid circuit board 53 is hung from the bottom portion, and is accommodated in the hollow space. The base body 51 makes the key actuating device 50 small.

Another key actuating device 60 may be equipped with solenoid-operated key actuator units 61 with built-in sensors 63. The sensor 63 monitors the plunger 38, and generates an electric signal representative of the plunger velocity. A retainer 62 is used for supporting the solenoid-operated key actuator units 61. The retainer 62 is deepened so as to accommodate the sensors therein.

The actuating device according to the present invention may be incorporated in another kind of keyboard musical instrument such as, for example, an automatic player piano fabricated on the basis of an upright piano, a harpsichord, a celesta and an organ.

The keyboard musical instrument according to the present invention may further include a hammer stopper and an electronic sound generating system. The keyboard musical instrument is called as "silent piano". The hammer stopper is provided in association with the hammers, and is changed between a free position and a blocking position. While the hammer stopper is maintained at the free position, the hammers strike the associated sets of strings without any interruption by the hammer stopper. When the hammer stopper is changed to the blocking position, the hammer stopper enters into the trajectories of the hammers, and the hammers rebound on the hammer stopper before striking the strings. The electronic sound generating system produces electronic sounds instead of the piano tones so that user can practice the fingering without disturbance to the neighborhood.

In the above-described embodiments, the guide rails 22 is used for defining the guide groove 23, and the angle bar portion 32C slides along the guide groove 23. However, the guide groove and the sliding plate are exchangeable between the yoke 31 and the base body 20. A single guide rail may be formed in the lateral direction along each side of the base body 20. In this instance, a groove is formed in the angle bar portion 32C, and is open to the lower surface of the angle bar portion 32C. The yoke rides on the single guide rail, and the single guide rail permits the yoke to slide without falling down. Similarly, a positioning rail may be formed on the outer surface of the inner wall portion. In this instance, a groove is formed in the angle bar portion 32C, and the single rail and the groove adjust the solenoid-operated key actuator unit to the appropriate height.

The solenoid-operated key actuator units may be arranged in a single row.

The actuating device is available for any kind of apparatus in so far as plural members to be actuated are arrayed. The actuators may pneumatically generate power.

What is claimed is:

1. A keyboard musical instrument for generating tones, comprising:

plural keys arranged in a lateral direction on a stationary board, and moved with respect to said stationary board for specifying pitches of said tones to be generated;

a tone generator responsive to motions of said plural keys for generating said tones; and a key actuating device provided in the vicinity of said plural keys for selectively moving said plural keys without fingering of a human player, and including a retainer elongated in said lateral direction, and formed with a guide extending in said lateral direction, plural actuators having sliding portions engageable with said guide so as to be moved in said lateral direction and a fastener provided between said plural actuators and said retainer and keeping said plural actuators at target positions in proximity to said plural keys, respectively.

2. The actuating device as set forth in claim 1, in which said guide is a groove defined between wall portions of said retainer extending in said longitudinal direction, and said sliding portions are inserted into said groove so that said plural actuators slides along said groove.

3. The actuating device as set forth in claim 1, in which each of said plural actuators is implemented by a solenoid-operated actuator unit having a solenoid to be energized with electric current, a yoke holding said solenoid and having one of said sliding portions downwardly projecting from a remaining portion of said yoke and a plunger projectable from and retractable into said solenoid, and in which said guide is a groove defined between wall portions of said retainer extending in said longitudinal direction and receiving said sliding portions so that said plural actuators slides along said groove.

4. The actuating device a set forth in claim 3, in which said solenoid-operated actuator unit further has a built-in sensor for producing an electric signal representative of current status of said plunger.

5. The actuating device as set forth in claim 1, in which said fastener has a pusher for pressing said plural actuators against said retainer.

6. The actuating device as set forth in claim 5, in which said pusher includes a first wall portion formed in said retainer and extending in said longitudinal direction, a second wall portion formed in said retainer in parallel to said first wall portion and a spacer plate inserted into a gap between said first wall portion and said second wall portion and pressing said sliding portions against one of said first and second wall portions.

7. The actuating device as set forth in claim 6, in which said pusher further includes bolts screwed into threaded holes formed in the other of said first and second wall portions so as to exert force on said spacer plate.

8. The actuating device as set forth in claim 6, in which said spacer plate includes a rigid plate and a resilient sheet fixed to said rigid plate and resiliently deformed between said first wall portion and said second wall portion so as to resiliently press said sliding portions against said one of said first and second wall portions.

9. The actuating device as set forth in claim 1, further comprising a positioning device provided between said retainer and said plural actuators for respectively positioning said plural actuators at said target positions.

10. The actuating device as set forth in claim 9, in which said positioning device has a groove extending in said longitudinal direction at a certain height and formed in said retainer, and projections formed in said plural actuators and insertable into said groove so as to position said plural actuator at a target height.

11. The actuating device as set forth in claim 9, in which said guide is another groove defined between wall portions of said retainer extending in said longitudinal direction, and said sliding portions are inserted into said another groove so that said plural actuators slides along said groove.

12. The actuating device as set forth in claim 9, in which each of said plural actuators is implemented by a solenoid-operated actuator unit having a solenoid to be energized with electric current, a yoke holding said solenoid and having one of said sliding portions downwardly projecting from a remaining portion of said yoke and a plunger projectable from and retractable into said solenoid, and in which said guide is a groove defined between wall portions of said retainer extending in said longitudinal direction and receiving said sliding portions so that the plural solenoid-operated actuators slides along said groove.

13. The actuating device as set forth in claim 12, in which said fastener includes a pusher inserted into said groove for pressing said sliding portions against one of said wall portions, and said positioning device includes another groove formed in said one of said wall portions at a certain height and extending in said longitudinal direction and projections respectively formed in said sliding portions and received in said another groove so as to adjust said solenoid-operated actuators to said target height.

14. The actuating device as set forth in claim 13, in which said groove, said pusher, said sliding portions and said projections respectively have a first width, a first thickness, a second thickness and a second width regulated in such a manner that said first width is greater than the sum of said first thickness, said second thickness and said second width.

* * * * *